United States Patent [19]

McCumber et al.

[11] 4,384,196

[45] May 17, 1983

[54] APPARATUS AND SYSTEM FOR PREPARING DATA CARDS AND MAILER FORMS AND FOR ATTACHING DATA CARDS TO RESPECTIVELY ASSOCIATED MAILER FORMS

[75] Inventors: Roger D. McCumber, Minnetonka; LeRoy E. Gerlach, Bloomington, both of Minn.

[73] Assignee: Data Card Corporation, Minnetonka, Minn.

[21] Appl. No.: 206,840

[22] Filed: Nov. 14, 1980

[51] Int. Cl.[3] ..... G06F 15/20

[52] U.S. Cl. ..... 235/375; 270/58

[58] Field of Search ..... 235/375, 385, 454, 449, 235/474, 489; 270/58, 1, 4, 52, 54; 364/464, 478; 340/153; 355/1; 156/384, 442; 101/2, 45; 53/266 A

[56] References Cited

U.S. PATENT DOCUMENTS

| | | | |
|---|---|---|---|
| 2,920,310 | 1/1980 | Sallach . | |
| 3,184,714 | 5/1965 | Brown, Jr. et al. . | |
| 3,242,637 | 3/1966 | Wills . | |
| 3,484,097 | 12/1969 | Jory | 270/52 |
| 3,593,913 | 7/1971 | Bremer . | |
| 3,606,728 | 9/1971 | Sather et al. . | |
| 3,704,015 | 11/1972 | Holovka, Jr. et al. | 270/52 |
| 3,800,124 | 3/1974 | Walsh . | |
| 3,804,226 | 4/1974 | Ellis | 400/531 |
| 3,819,173 | 6/1974 | Anderson et al. | 270/1.1 |
| 3,899,165 | 8/1975 | Abram et al. | 270/54 |
| 3,899,381 | 8/1975 | O'Brien et al. | 156/204 |
| 3,917,252 | 11/1975 | Harder et al. | 270/58 |
| 3,965,644 | 6/1976 | Stocker | 270/58 |
| 4,034,210 | 7/1977 | Hill et al. . | |
| 4,065,661 | 12/1977 | Jaskowsky | 364/464 |
| 4,088,216 | 5/1978 | LaManna et al. | 400/130 |
| 4,194,685 | 3/1980 | Hill et al. | 235/375 |

FOREIGN PATENT DOCUMENTS 1449994 7/1969 Fed. Rep. of Germany .

OTHER PUBLICATIONS

GB 2012243A, Hewitt et al., Jul. 25, 1979, Data Card and Mailer Data Match/Inserter System.

Brochure Flyer on VIS Machine, Dynetics, Sep. 14, 1976–Exhibit W.

Study for Computer Inputting, 1966, pp. 351–359, "Turn Around System"–Exhibit X.

Dynetics Engineering Corporation, Prerelease Bulletins on Credit Card Inserting Machines–Exhibit T.

Advertizing Brochure for Credit Card Inserting Machine of Stephens Industries, Inc. (Model #6302)–Exhibit U.

Laid-Open Patent Application, Japanese, Publication No. S-55-20255–Exhibit P.

Japanese Publication No. 55-69884–Exhibit Q.

Nilson Report, Aug. 1975, Issue 121–Exhibit S.

Dynetics News Release Bulletins on VIS Machine and Operation–Exhibit V.

*Primary Examiner*—Donald J. Yusko

*Attorney, Agent, or Firm*—Staas & Halsey

[57] ABSTRACT

A system for attaching data cards to mailer forms including apparatus having a supply of serially connected mailer forms, a paper drive for the forms and a printer therefore, a card holding station for holding up to two data cards in position for pickup by a printed mailer form having divergent slots for receiving opposite end portions of the data cards, a burster for separating an individual card carrying printed mailer form from the serially connected forms, a folder, an output stacker and a form reject area. Electronic control circuitry is included for controlling the operation of the various stations in a cooperative manner and for assuring that the mailer forms are printed with information corresponding to the data cards which will be inserted therein.

26 Claims, 21 Drawing Figures

APPARATUS AND SYSTEM FOR PREPARING DATA CARDS AND MAILER FORMS AND FOR ATTACHING DATA CARDS TO RESPECTIVELY ASSOCIATED MAILER FORMS

BACKGROUND OF THE INVENTION

1. Field of the Invention

This invention relates to a system for automatically attaching data cards to respectively associated mailer forms and especially to a system which receives information from a common data source for embossing and/or encoding a magnetic stripe on the data cards and for printing the mailer forms with corresponding information. The system controls the subsequent processing and handling of cards and forms to assure that the cards are attached to their properly corresponding, respectively associated forms.

2. Description of the Prior Art

There exist, in the prior art, systems for automatically matching embossed data cards with pre-printed mailer forms and for attaching the data cards to their matching, respectively associated pre-printed mailer forms. One such prior art system is manufactured and sold under the trademark "DATA-MATCH" by Data Card Corporation, assignee of the present application, and affords highly reliable, high speed operation. The system includes an optical character reader for reading the pre-printed forms and an embossed character reader (ECR) or a magnetic stripe reader for reading data correspondingly embossed or encoded on the data card. The two sets of data thus read are then compared to verify that a match exists. When the requisite number of correctly matched cards for a given form is available, they are simultaneously attached to that form.

Prior art systems of the type of the "DATA-MATCH" inserter are designed to function as independent systems, implying that separate apparatus is employed to emboss/encode the credit cards and to print the mailers, prior to the supply of the mailer forms and data cards to the DATA-MATCH inserter. These independent operations introduce the potential of errors particularly as to mis-matching of cards and forms. For example, if a card is lost or if cards are out of sequence in the supply thereof relative to the corresponding sequence of the pre-printed mailer forms, a mismatch error will be detected by the system; moreover, if any mailer form is printed imperfectly such that it is not readable by the DATA-MATCH inserter or is incorrectly read, or should other defects exist whether in reading or transporting the form, an error condition will occur. The DATA-MATCH inserter permits operator intervention to correct for the circumstance of an erroneous machine detection of a mis-match condition (e.g., a form is correct but has been misread by the system resulting in an erroneous mismatch error condition). However, where either the form or a required card therefor is in fact defective, or a card is missing, there is no recovery capability in the sense that the imperfect form and any associated cards must be rejected, since replacements are not readily available.

There is therefore a need in the industry for a system which automates the totality of involved functions, namely the embossing and/or encoding of the data cards as well as the printing of the forms and the attachment of the appropriate number of correctly matching cards to the respectively associated forms. Moreover, there is a need in the industry for a system which permits recovery of operations when an error condition occurs. By way of example, in a system which combines and automates all of the requisite functions as above described, reprinting of defective forms or re-embossing of defective cards can be achieved such that, where normal automated processing results in rejects of either forms or cards, the system can print substitute or replacement forms or produce substitute or replacement cards, as required, such that at the end of a run, all cards and forms have been successfully generated and assembled. There is also a need for a low-cost such system, suitable for use by low-volume issuers of credit cards and thus one which, while not having the speed of operation of the DATA-MATCH inserter, nevertheless is available in a less complex mechanism and at lower cost for such lower-volume card issuers.

SUMMARY OF THE INVENTION

An object of the present invention is to provide a system for the attachment of data cards to mailer forms which overcomes the deficiencies of prior art systems.

In particular, it is an object of the present invention to provide a system for the attachment of the correct number of data cards to properly matching mailer forms, but which does not require reading of data from either the cards or forms, or comparison of the data for verification that there is a match between the data of a particular data card and its corresponding mailer form.

A further object of this invention is to provide a system wherein up to two data cards are held in position while a mailer form, having predetermined slots of slanted divergent configuration, passes thereby and is flexed to pick up, within the slots, the respective ends of the data cards and thereby retain them with the mailer form.

A further object of this invention is to provide electronic circuitry for controlling the placement of identifying information on respective data cards and for employing corresponding identifying information, provided by a common data source, to print or otherwise provide desired information on a mailer form which will be associated with the corresponding data cards. The apparatus is always subject to operator intervention, wherein an operator responds to an error signal and takes steps to correct the cause of the error.

The system and apparatus of the present invention have a number of novel features, as set forth below. A data card is embossed, encoded, printed, or otherwise formed and is then fed, for example, by a conveyor belt transport mechanism, to a card transfer and pickup station. If more than one data card is to be attached to a particular mailer form then the second data card is embossed, encoded, printed, or otherwise formed and is then fed to the card transfer and pickup station. When the required number of data cards reaches the transfer and pickup station, the card(s) are moved transversely so as to be placed in a position for insertion on a mailer form.

In timed relationship to the card processing and transporting functions, serially connected, blank mailer forms are fed from a form supply by a paper drive system, past a printer station and to the pickup or insertion station. Print data from the data card indicia or code forming apparatus is fed to the printer station for printing information on the mailer form corresponding to the information which is used to form the particular data card or cards. For example, a particular data card may be embossed with the name and account number of an individual (i.e., the account holder); in timed relationship, corresponding information, which may include the account holder's name and address, is printed on a mailer form currently positioned at a print station. The mailer form is then fed to the data card pickup station to pick up the card(s).

For this purpose, each individual mailer is provided with two sets of divergent slots spaced to receive the ends of two corresponding data cards held at the pickup station. As the mailer form approaches the pickup station, spring fingers deflect portions of the mailer form adjacent the divergent slots, thereby opening the slots. As the printed mailer form moves past the held data cards, the respective ends of each data card are received within the opened, divergent slots, and when the remote ends of the divergent slots engage the lower edge of each card, the form picks up the cards and removes them from the card pickup station.

As the printed mailer form is picking up the cards, the succeeding mailer form is being transported toward the form printing station. Transport of the forms continues until the succeeding form is at the print station. At that time, the burst line (i.e., a pre-perforated line) delineating the trailing edge of the printed form containing cards and the succeeding, blank form currently at the print station, is positioned at a burster station. During this time, the card-carrying mailer form is checked by a detection device positioned a predetermined distance past the card pickup station to determine if the proper number of cards are attached to the mailer form. At the burster station, the mailer forms are tensioned and gripped and a bursting bar is moved transversely of the plane of the forms to burst, or sever, the mailer forms along the burst line. The burst, card-carrying mailer form then is advanced into a folder mechanism.

In the folder mechanism, the form is folded. If the detection device determined that a particular mailer form does not have the correct number of data cards associated therewith, the defectively filled mailer form will be automatically rejected from the folder into a form reject area. Assuming the required number of cards has been picked up by the form, the card-filled and folded mailer form is then fed to an output stacker. An operator can then remove the folded mailer forms for stuffing into mailing envelopes; optionally, an envelope stuffing machine may be attached to receive the folded mailer forms and automatically stuff the folded mailer forms into mailing envelopes.

In an optimum embodiment of the present invention, semiautomatic error recovery is performed. If an error signal is generated (for example, because of a card jam, a form jam or a missing second card), the operator may clear the system of all cards and forms and rewind the data tape to the position where the error has occurred. The operator may then restart the automatic processing of the system. In this manner, once a particular tape run is finished, all of the data cards are attached to their corresponding mailer forms and no further processing (for example, manually generating cards or forms in which the errors have been found) is necessary.

The system and apparatus of the present invention have significant advantages over the prior art in that no separate equipment is required for form printing, no readers for either forms or cards are required, and the complexity of the system is substantially reduced, making machine operation and error recovery simple.

These together with other objects and advantages, which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
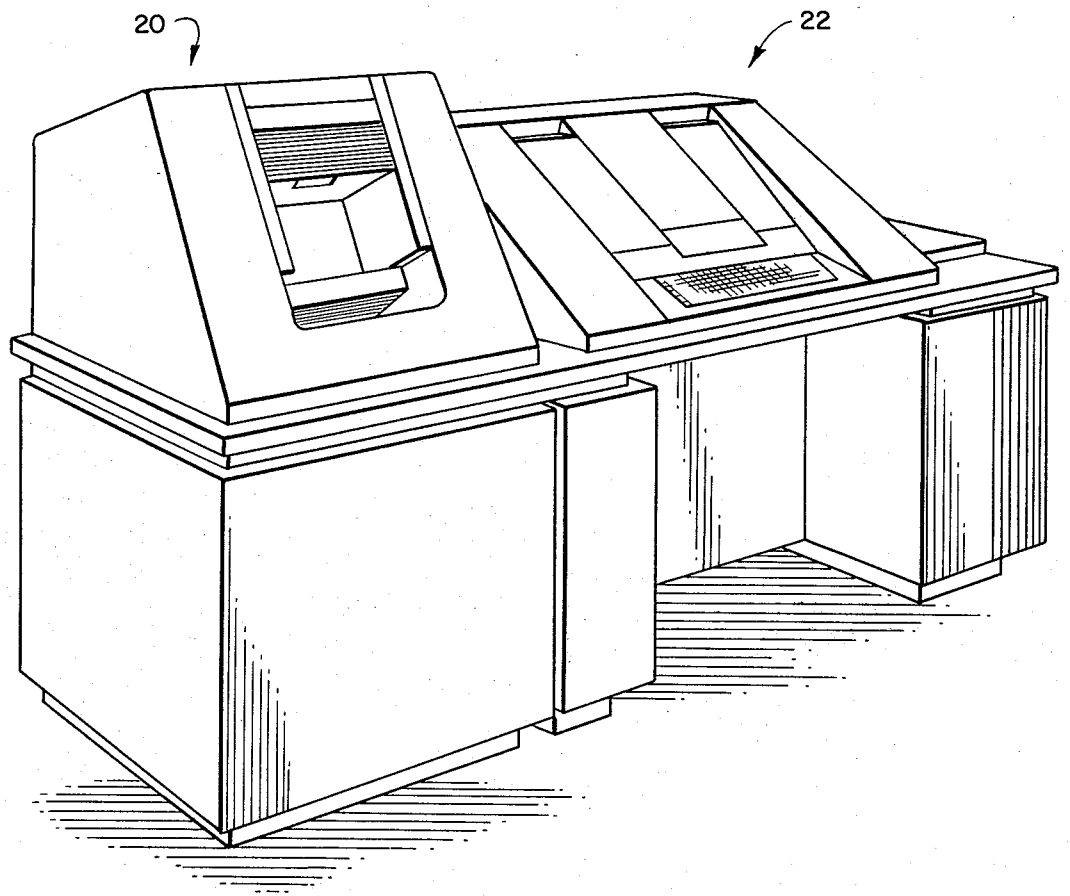
FIG. 1 is a perspective view of the overall system of the present invention.
Figure 10:
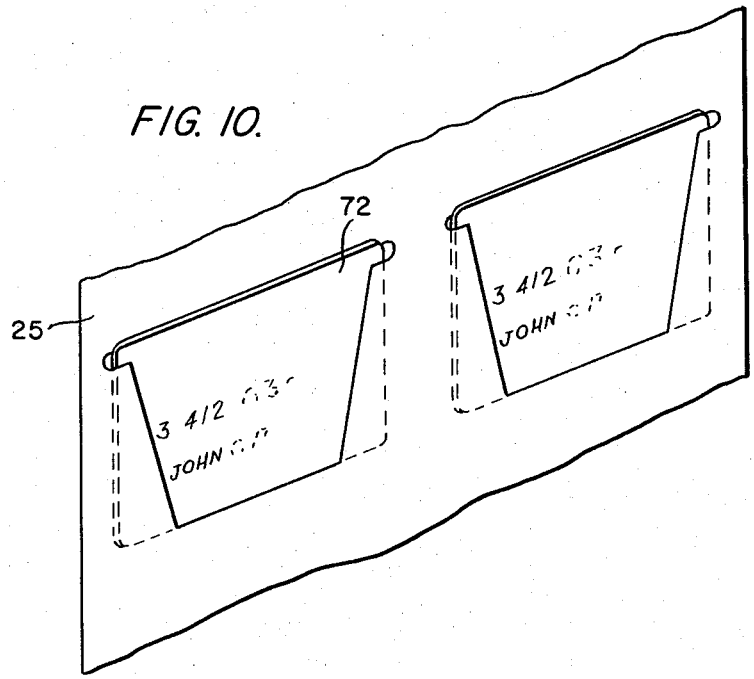
FIg. 10 is a perspective view of a fragmentary portion of a mailer form containing two data cards.

FIG. 1 illustrates the overall system of the present invention. The form printing and card attachment apparatus (or inserter) of the present invention is identified by numeral 20. Apparatus for encoding and embossing, printing, molding or otherwise forming the data cards is indicated, in general, by reference numeral 22 (hereinafter, referred to as the embosser/encoder 22). In the preferred embodiment, an embossing/encoding machine substantially corresponding to the Data Card Series 4000 embossing machine is used, that machine being described in U.S. Pat. No. 4,088,216 the disclosure of which is hereby incorporated by reference. A common supply of card account and identification data, such as from magnetic tape, is employed for both the embosser/encoder 22 and the form printing and card attachment apparatus 20, as later described in detail. In the preferred embodiment, an embosser/encoder employing a magnetic tape data input as illustrated in FIG. 10 of the '216 patent is employed; however, the tape format and internal data handling of the embosser/encoder disclosed in the '216 patent are modified in accordance with the present invention.

Figure 2:
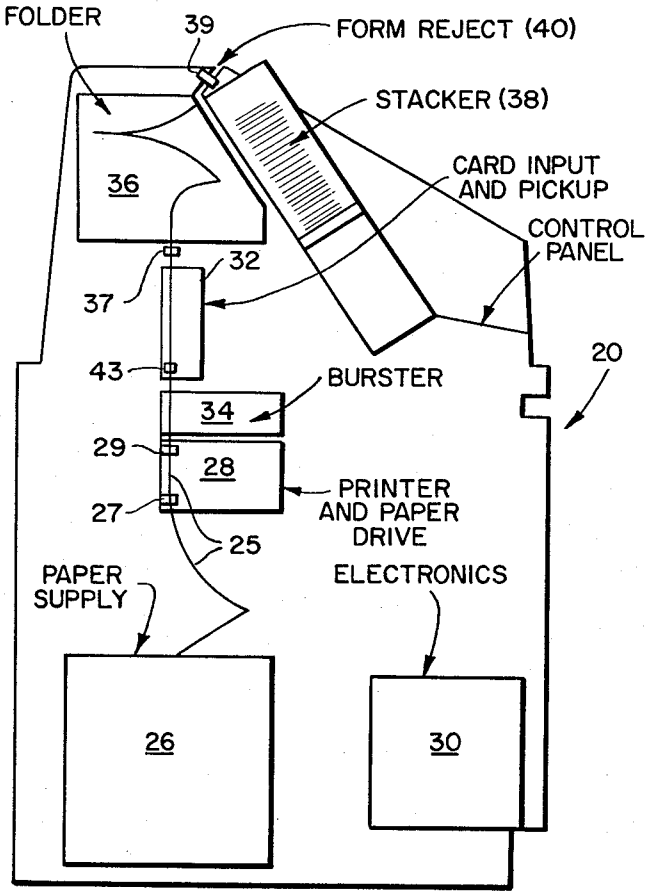
FIG. 2 is a left side elevational view depicting, in block format, the basic components comprising the printer, burster, folder and card pickup stations.

Referring to FIG. 2, the form printing and card attachment apparatus 20 receives a supply 26 of serially connected, blank mailer forms 25 and includes printer and paper drive apparatus 28, and electronic control circuitry 30. A photocell 27 detects whether there are any mailer forms present, and a photocell 29 detects when a given, or current, mailer form 25 is in a "top of form" position, ready for printing thereon. The electronic control circuitry 30 receives account identification information corresponding to that information currently employed by the embosser/encoder 22 for forming the data card for that account, to control the printer and paper drive apparatus 28 for printing the corresponding mailer form for those cards. That is, after the first of a required number of data cards (1 or 2) is formed in embosser/encoder 22, corresponding account identification information is transmitted to the electronic control circuitry 30 for use by the form printing and card attachment apparatus 20.

Figure 18:
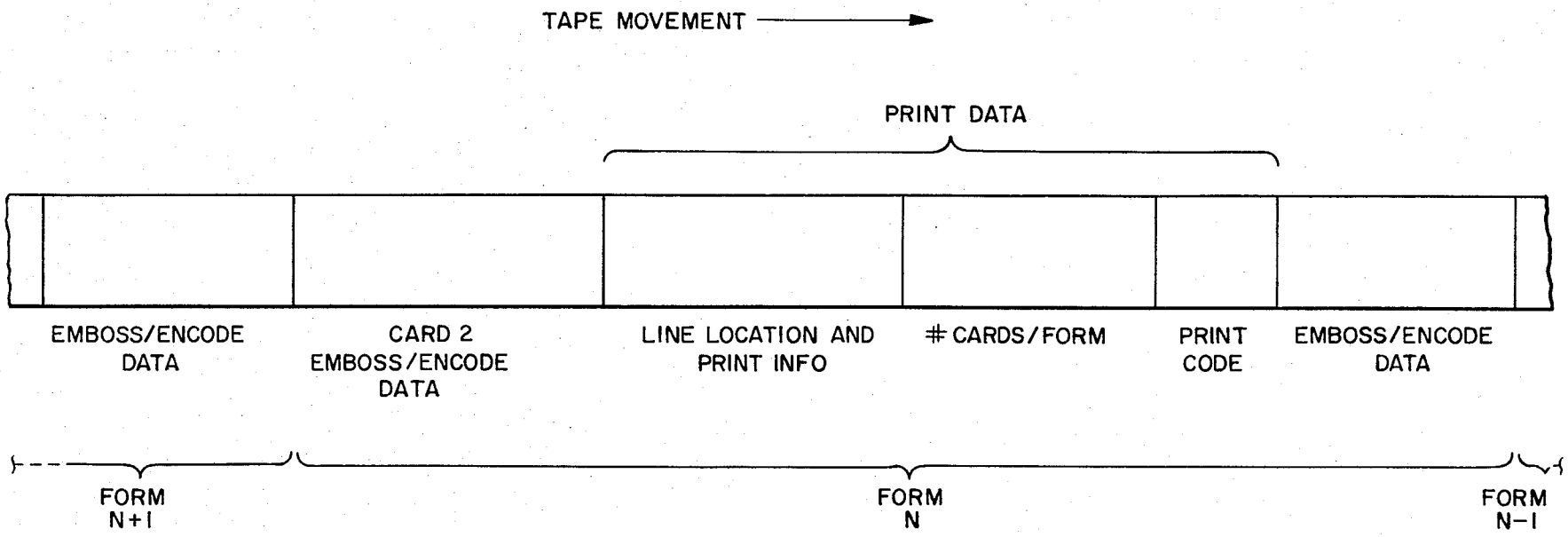
FIG. 18 illustrates the format of the data on the magnetic tape which may be employed as the common data source in the present invention.

FIG. 18 illustrates the data format on the magnetic tape for a given account. Although many other formats are possible and come within the scope of this invention, the format of FIG. 18 is especially well adapted to the processing functions to be performed by the present system. Particularly, the requisite data and information for successive forms N−1, N, N+1, . . . is formatted in serial succession. For a given Form N, the embosser/encoder 22 receives the EMBOSS/ENCODE DATA as read from the tape and forms a data card with corresponding, embossed and/or encoded identification information. This data typically includes at least an account number or other unique identifying number, and may include the name and other identification information (e.g., expiration date) of the card or account holder and the account itself. The magnetic tape also carries PRINT DATA which is sent by embosser/encoder 22 to the electronic control circuitry 30 where it is processed and sent to the printer and paper drive apparatus 28. The PRINT DATA includes PRINT CODE data, (e.g., the same account number as for the EMBOSS/ENCODE DATA and, typically, not only the name but also the mailing address for the card or account holder), NUMBER OF CARDS/FORM data (indicating the number of cards for the particular form), and LINE LOCATION AND PRINT INFORMATION data (indicating the printing format). If a second card is to be placed in a particular mailer form, "CARD 2 EMBOSS/ENCODE DATA" will be present on the tape. The embosser/encoder 22 will read the CARD 2 EMBOSS/ENCODE DATA and will emboss and/or encode a second card. If a second card is not needed for a particular form, "CARD 2 EMBOSS/ENCODE DATA" is omitted.

The apparatus of this invention prints the identification information on a mailer form after the first of a required number of data cards has been embossed, but prior to the attachment of any data cards to the associated form. As later described, the sequence and timing of the transfer of print data to the apparatus 28, in relation to embossing/encoding functions, guarantees that the intended correspondence of the printed form and embossed/encoded cards is achieved. After the identification information has been printed on the mailer form 25 and the desired number of cards have been received at the card pickup station 32, the printed mailer form 25 is transported past the pickup station, to pick up the associated cards as previously described. In this manner, the form printing and card attachment apparatus of the system of the present invention effectively eliminates the source of errors encountered in reading and matching operations which are required in prior art systems which assemble pre-printed forms and pre-embossed/encoded cards, yet still assures that only the properly corresponding mailer forms and data cards are assembled.

In the form printing and card attachment apparatus 20, a card input and pickup station 32 receives the embossed/encoded cards from the topper mechanism (see FIG. 10 of U.S. Pat. No. 4,088,216) of the embosser/encoder 22 by way of a card transport mechanism (FIG. 3) and moves the cards into position for card pickup by the associated, printed mailer form 25. The serially connected mailer forms 25 are fed upwardly so that the corresponding printed form 25 proceeds upwardly past the card input and pickup station 32 where it engages and picks up the associated data cards, removing same from the card pickup station 32.

The movement of the serially connected forms 25 continues until the burst line delineating between the card-carrying printed from 25 and the succeeding blank form 25 is positioned at burster station 34. The succeeding form 25 is then at the "top of form" position, as detected by a signal from photocell 29. Burster station 34 separates the card-carrying printed mailer form 25 from the following, serially-connected blank mailer forms 25 and the card-carrying printed mailer form 25 is then sent to a folder station 36.

A pair of photocell 37 detects whether or not the required number of cards are properly inserted in mailer form 25 before the form 25 is folded. After the card-carrying printed mailer form 25 is folded by the folder station 36, it is fed to an output stacker 38. A "folder-out" photocell 39 is used to generate a detection signal indicating that the card-carrying mailer form 25 has exited folder station 36; so the detection signal is supplied to the electronic control circuitry 30 which thereby monitors the elapsed time of travel of the form through the folder, for jam detection. An operator then removes the successfully assembled and properly folded card-carrying mailer forms in a stacked group from stacker 38 for further processing, e.g., stuffing into mailing envelopes for mailing to the designated recipients of the cards. In an alternative embodiment, an automatic envelope stuffer may be attached to the output of the form printing and card attachment apparatus 20 so that the card-carrying printed forms 25 may be automatically stuffed into envelopes. If the photocells 37 detect a defectively filled form (e.g., a form containing less than the required number of cards or in which the cards are askew) the latter is rejected, after leaving the folder 36, into a form reject area 40 rather than to stacker 38.

Figure 3:
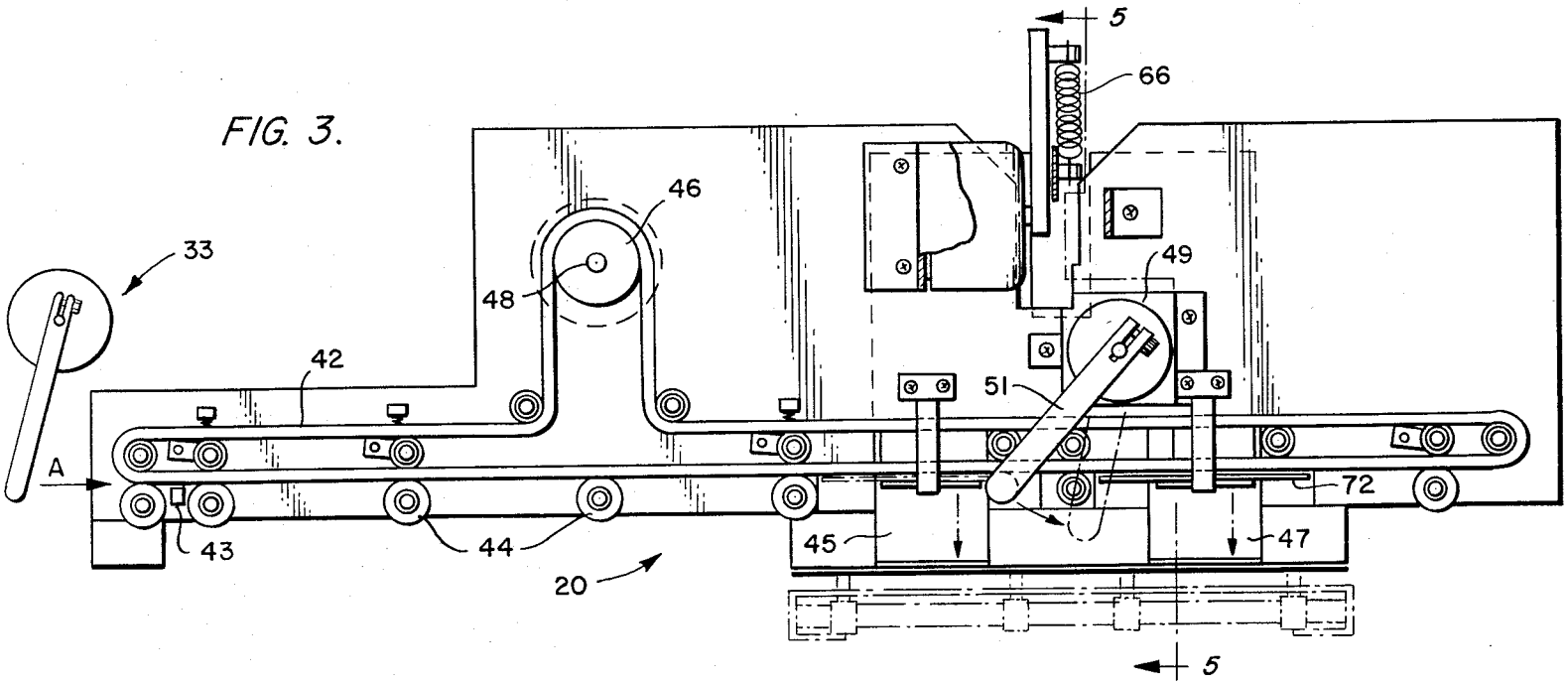
FIG. 3 is a top plan view of the data card transport mechanism, card diverter structure, and card pickup station.
Figure 4:
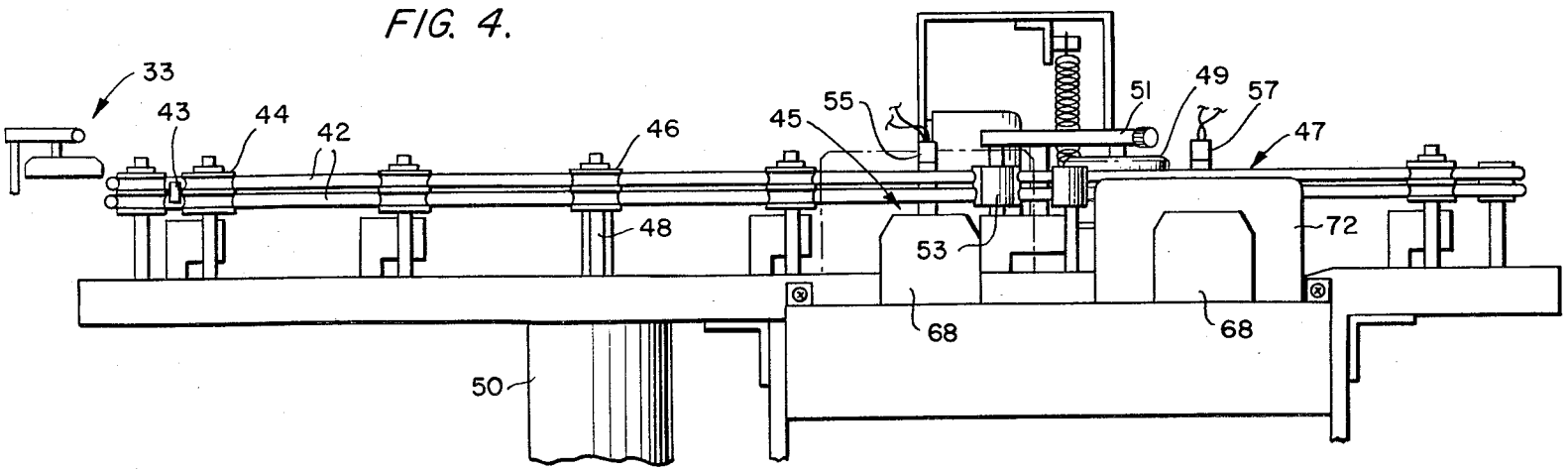
FIG. 4 is a rear elevational view of the structure of FIG. 3.

Referring to FIGS. 3 and 4 of the drawings, the card input and pickup station 32 will now be described. A pair of data card transport belts 42 are supported by pulleys 44 and driven by a drive pulley 46 mounted on the drive shaft 48 of a track motor 50. A card (e.g., as shown at 72) is pushed onto the transport belts 42 by solenoid driven arm 33 positioned at the output of the topper mechanism of the embosser/encoder 22 and is transferred by belts 42 in the direction indicated by arrow A in FIG. 3, into the form printing and card attachment apparatus 20. A photocell 43 detects the presence of the card on the transport belts 42 and generates a detection signal. The card is transported on the transport belts 42 until it reaches either a first bin (pocket) 45 or a second bin (pocket) 47. A rotary solenoid 49 and its attached bracket arm 51 and pinch roller 53 are actuated in dependence upon whether one or two data cards are required for a given account, and thus for attachment to a corresponding mailer form 25. When the bracket arm 51 is in the position illustrated in solid lines in FIG. 3, the data card will be caught between belts 42 and pinch roller 53 and will not drop into bin 45 but will be transported to bin 47. When the bracket arm 51 is moved to the position indicated by the dotted lines in FIG. 3, the data card will drop into bin 45. If only one card is required the bracket arm 51 is maintained in the dotted line position, as seen in FIG. 3, so that the single card will drop into bin 45. Thus, the rotary solenoid 49 is selectively actuated in dependence upon the number of cards required to be inserted (NUMBER OF CARDS/FORM, FIG. 18). Photocells 55 and 57 detect the presence of cards in bins 45 and 47, respectively, and generate detection signals.

Figure 5:
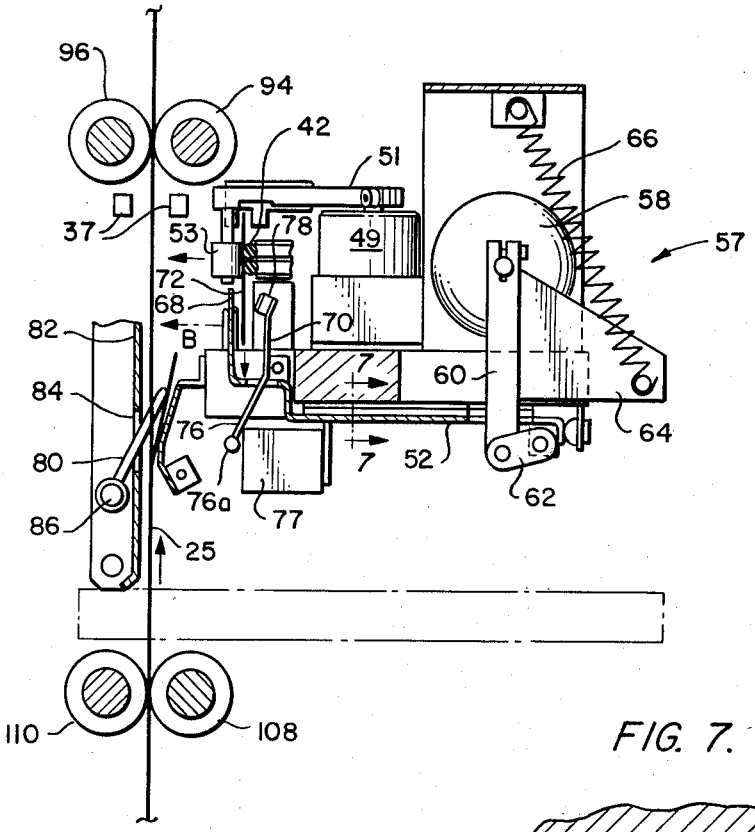
FIG. 5 is a side elevational view, partly in cross-section, taken generally along lines 5—5 of FIG. 3 showing the card pickup station.
Figure 7:
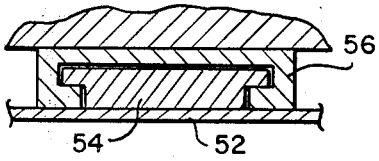
FIG. 7 is a fragmentary portion of a cross-sectional view taken generally along lines 7—7 of FIG. 5.
Figure 6:
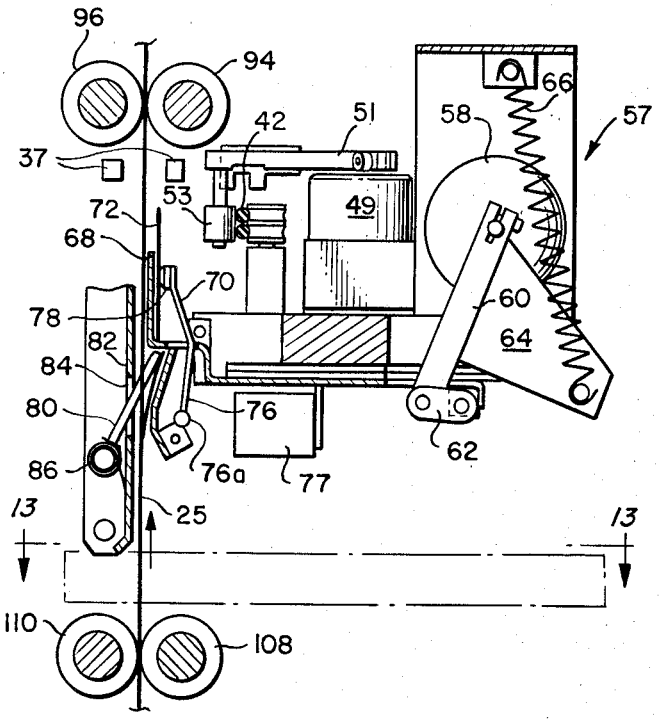
FIG. 6 is a view similar to FIG. 5, showing the relative positioning of the mailing form and data card just prior to attachment of the data card on the form.

FIGS. 5 and 6 are side elevational views of the apparatus for attaching a data card(s) on mailer form 25, in relation to card bin 45 of the card input and pickup station 32, illustrating two different states of operation. As noted above, if only one card is required this card will drop in the bin 45 and if two data cards 72 are required, the second data card 72 is dropped into bin 47 (not shown in FIGS. 5 and 6). A slideable transverse plate 52 has fixedly attached thereto a T-shaped guide block 54 received and supported in sliding engagement by a support mount 56 (FIG. 7). A thrusting apparatus 57, including a rotary solenoid 58, an eccentric linkage 60, an extension 64 and a spring 66, reciprocates the transverse plate 52. Transverse plate 52 includes an upright plate portion 68 which cooperates with a corresponding pivotable clamp member 70 (one for each of bins 45 and 47) to releasably engage data card 72 therebetween. Thus, one or a pair of data cards 72 may be simultaneously held in position at the card pickup station 32 in the bins 45 and 47.

Figure 8:
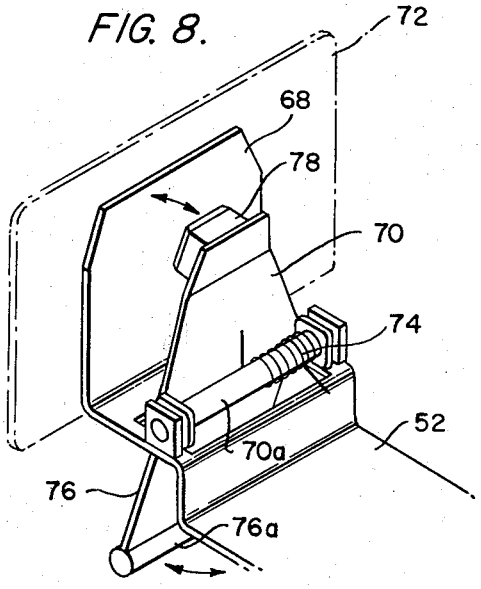
FIG. 8 is a perspective view of the data card retention structure of the card pickup station.

As best seen in FIG. 8, the pivotable clamp member 70, having a contact member 78 and a lever 76 with an abutment **76*a*, is pivotally mounted by shaft 70*a* to plate 52 and biased against the associated upright plate 68 by a coil spring 74 to clamp the card 72 in position (FIG. 6). Pivotable member 70 is pivoted away from upright plate 68 to an open position, by abutment 76 engaging a stationary stop 77 (FIG. 5), to receive a data card 72 therebetween. After data card 72 is positioned between upright plate 68 and contact member 78 (FIG. 6), the transverse plate 52 is moved toward the left, i.e., in the direction indicated by arrow B in FIG. 5, to the position shown in FIG. 6, releasing, or freeing, lever 76 from stationary block 77; the coil spring 74 thereupon rotates the pivotal clamp member 70 and causes the contact member 78 to grip the data card 72 against the inner surface of upright plate 68. When the transverse plate 54 completes its movement to the far left (FIG. 6), the data card 72 (or pair of cards) is then in proper position for pickup by its associated printed mailer form 25**.

FIG. 5 shows the printed mailer form 25 and the spring biased fingers 80 which contact and deflect the form portion adjacent to the slots to open the slots to a card receiving position. An upright guide 82 is provided with slots 84 through which the spring biased fingers 80 protrude. The spring biased fingers 80, as best seen in FIG. 9, are mounted on a pivot rod 86, which is biased by a coil spring 88 so that the fingers 80 are spring biased to a right-most position (clockwise direction), as shown in FIGS. 5 and 6.

Figure 9:
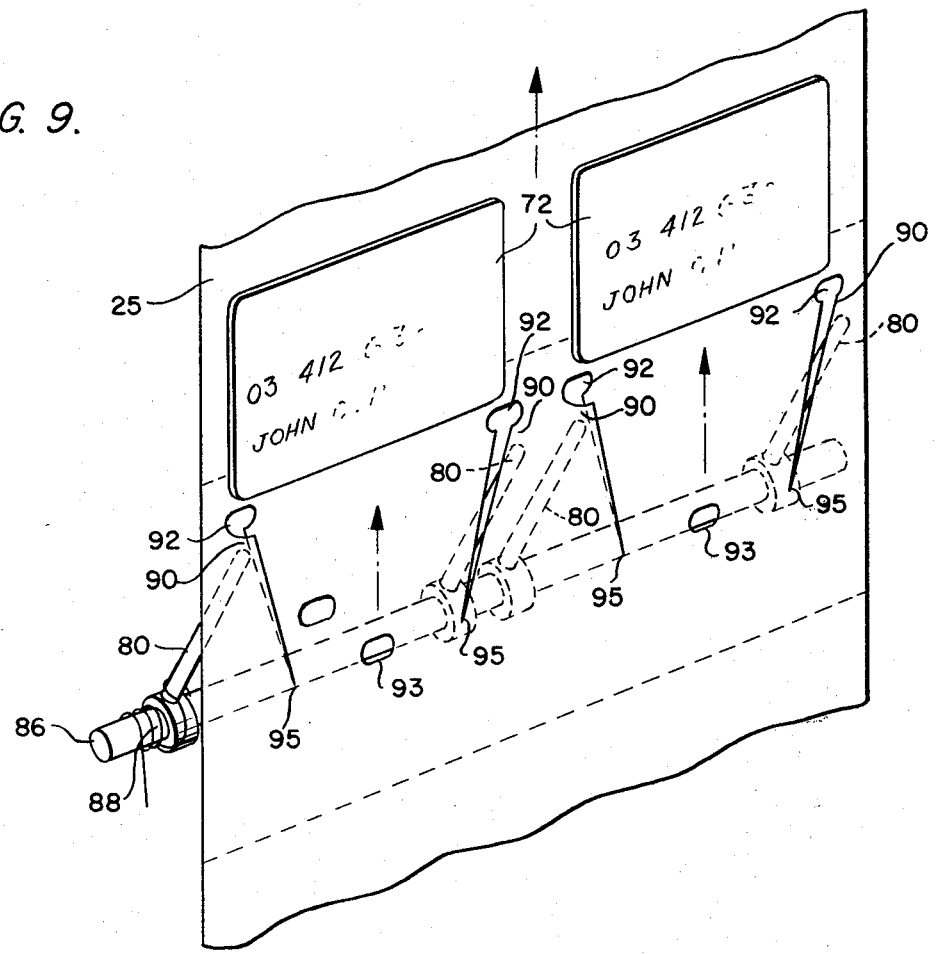
FIG. 9 is a perspective view of the divergent slot configuration of an individual mailer form, the slot opening spring-biased finger structure, and two data cards in position ready for pickup thereby.

Referring to FIG. 9, as each printed mailer form 25 moves upwardly, the individual spring biased fingers 80 extend through slots 84 in the upright guide 82 to contact and deflect the form portions 90 adjacent the slots 92 to open the slots 92. The opened slots 92 receive the lower end corners of the cards 72, and, as the form 25 continues its upward travel, the bottoms 95 of the divergent slots 92 engage the lower, or trailing, edges of the cards 72, as shown in FIG. 10, removing the data card(s) 72 from engagement by the upright plate 68 and contact member 78 (FIG. 6). The printed mailer form 25, with the data card(s) 72 held thereby, is then burst and fed upwardly by rollers 94 and 96 (FIG. 11) until it is in a position to be gripped by driven rollers (driven through a belt 126 in FIG. 11) in the folder station 36.

Figure 11:
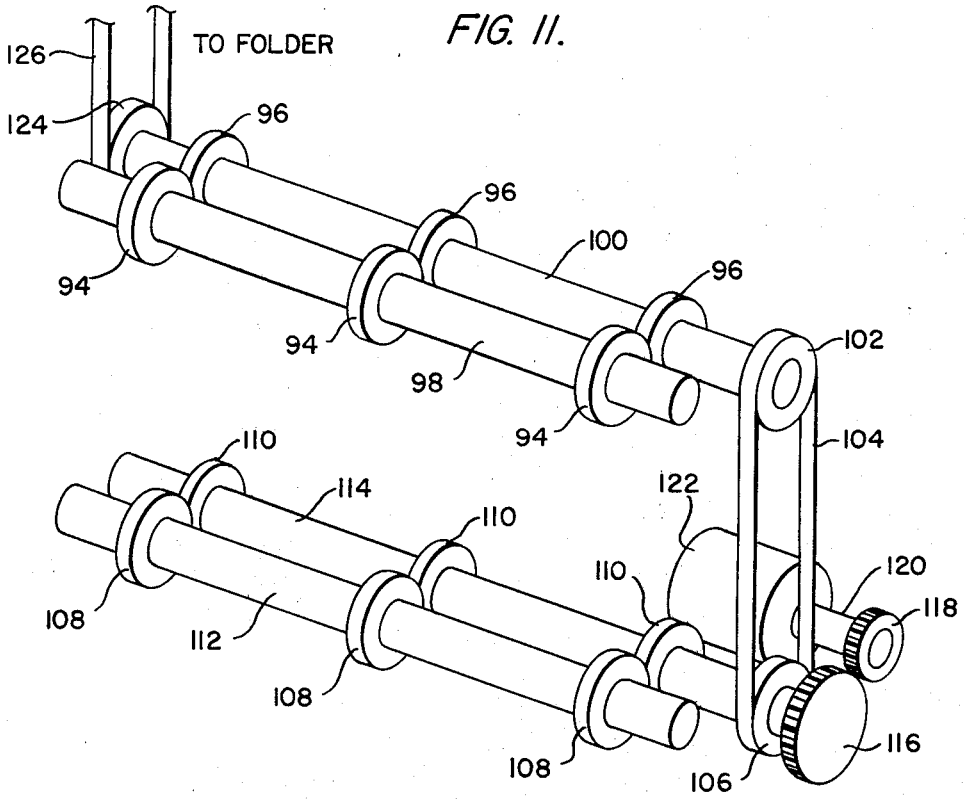
FIG. 11 is a perspective view of the clutch drive mechanism for driving the form output feed rollers and the folder input rollers.

Referring to FIG. 11, upper feed rollers 94 and 96 are mounted upon an idler shaft 98 and a driven shaft 100, respectively. The idler shaft 98 is supported for free rotation in bearings mounted on support frame members (not shown) while the driven shaft 100 is similarly supported in bearings and has a drive pulley 102 fixed at one end thereof. The drive pulley 102 is in turn driven by belt 104 and drive pulley 106. Lower feed rollers 108 and 110 are mounted on idler shaft 112 and driven shaft 114, respectively. A gear 116 is driven by pinion 118 affixed to the output shaft 120 of motor 122. Motor 122 is selectively energized under control of the electronic control circuitry 30. The driven shaft 100 carries at its opposite end from the drive pulley 102, a drive pulley 124 for driving a belt 126 which powers the folder mechanism of the folding station 36. The folding station 36 may be of the type disclosed in co-pending application Ser. No. 866,941, filed Jan. 4, 1978 and assigned to the assignee of the present application, the disclosure of which is hereby incorporated by reference (see FIGS. 32–36 of Ser. No. 866,941).

Figure 15:
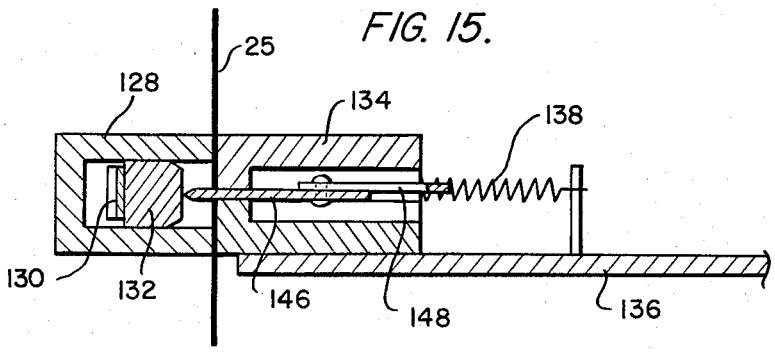
FIG. 15 is a left side elevational view of the form burster structure, partly in cross-section, taken generally along lines 15—15 of FIG. 13.

FIGS. 12–15 show features of the burster mechanism of the burster station 34 for separating the printed mailer form 25 from the serially connected supply of forms 25. A U-shaped channel member 128 (FIG. 14) has mounted therein an elongated spring 130 which biases a resilient pad 132 to the open edge of U-shaped channel member 128. A complementary member 134 is mounted for transverse movement on a support plate 136 and is restrained against such transverse movement by retainer springs 138. When a rotary electro-solenoid 140 is actuated, it moves an arm 142 with a roller 144 thereon to force the complementary member 134 towards and against the mailer forms 25 (see FIGS. 12 and 15) to engage same against the U-shaped channel member 128 (FIG. 15).

Figure 12:
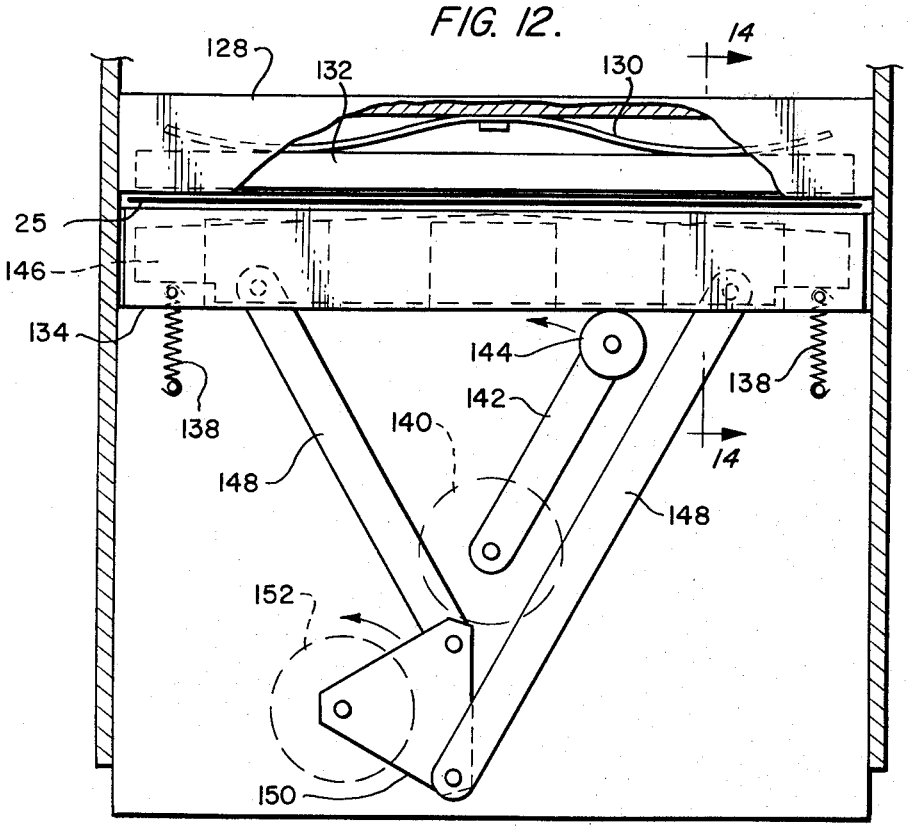
FIG. 12 is a top plan view of the form burster structure in a normal, rest position.
Figure 13:
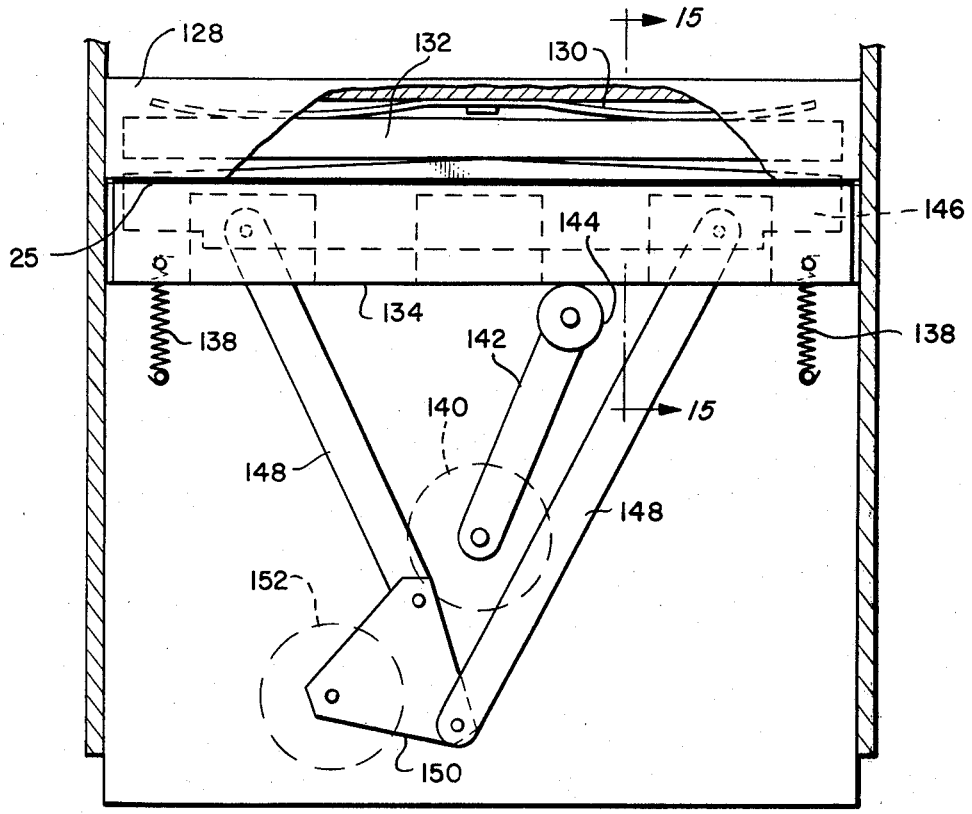
FIG. 13 is a top plan view of the form burster structure in an advanced, activated position.
Figure 14:
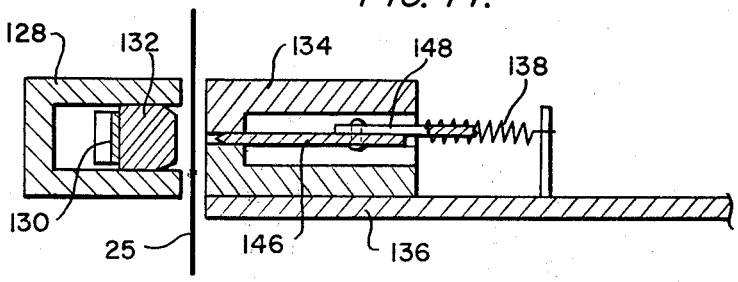
FIG. 14 is a left side elevational view of the form burster structure, partly in cross-section, taken generally along lines 14—14 of FIG. 12.

Once the burst (perforation) line between the mailer forms 25 is taut, burster knife 146 is advanced by linkages 148 actuated by movable plate 150 mounted on and driven by electro-solenoid 152, to burst an individual mailer from 25 from the successive serially-connected form. The tangential relationship of the unequal length linkages 148 causes burster knife 146 to move in a totally parallel manner. After the bursting action takes place, both electro-solenoids 140 and 152 are de-energized to permit springs 138 to retract all the elements to their inactive or rest positions (FIG. 12).

Figure 16:
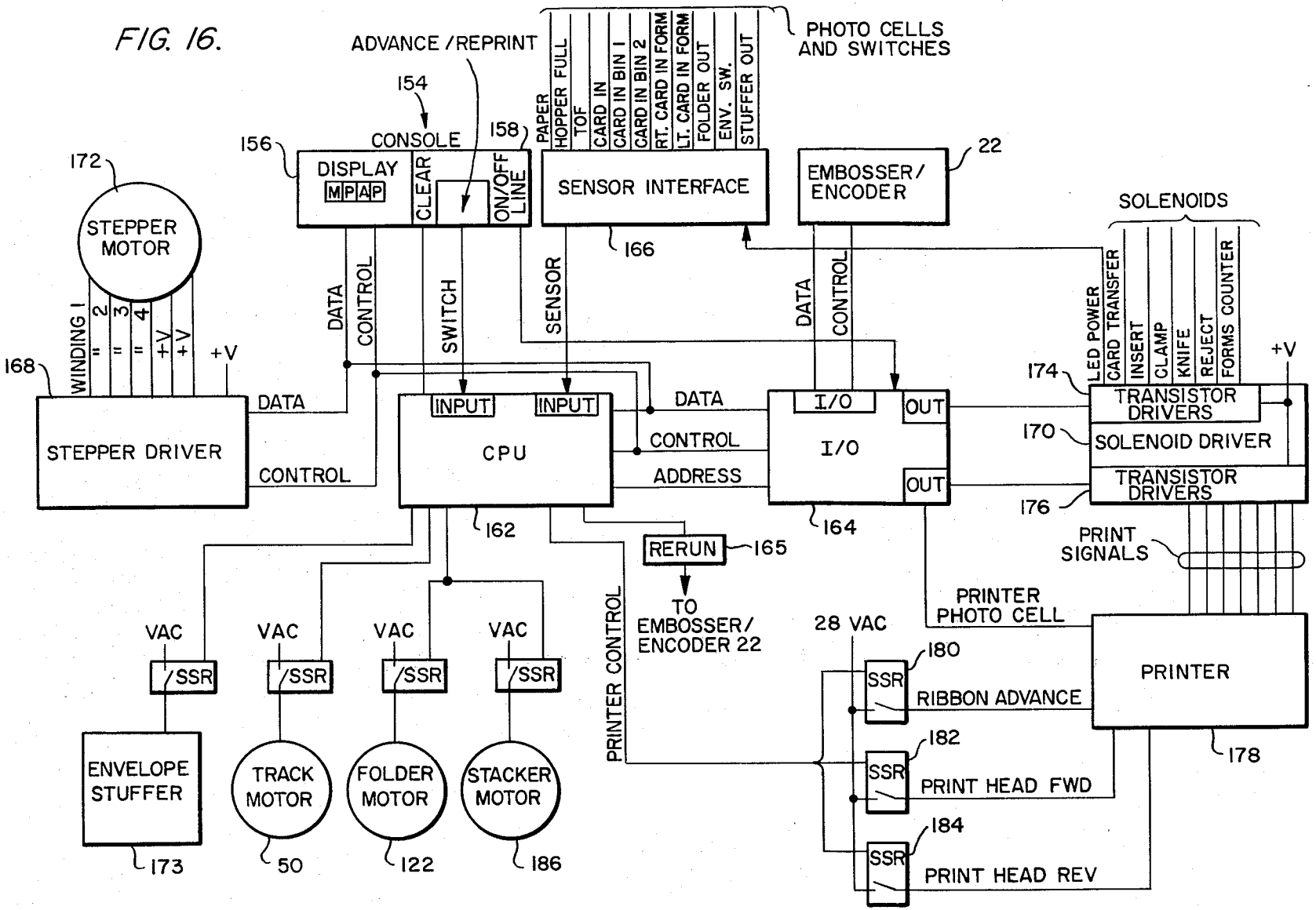
FIG. 16 is a block diagram illustrating the electronic control circuitry 30 of FIG. 2 and other related circuitry.

FIG. 16 is a block diagram illustrating the interconnection between embosser/encoder 22, the motors, printer and electronic control circuitry 30 of the present invention.

A console 154 includes a display 156 and a control switch panel 158. The display 156 will indicate various conditions in the system, for example, no paper, jam, error, no card, etc. The panel 158 includes a CLEAR switch, ADVANCE switch, REVERSE/REPRINT switch and ON/OFF LINE switch.

The CLEAR switch is employed to initialize the microcomputer network of the form printing and card attachment apparatus 20. The card transport (or track) motor 50 is turned on to clear any cards from the transport belts 42 and a mailer form 25 is then advanced, burst, folded and discharged into the form reject area 40.

The ADVANCE switch is functional only when the inserter is off line. When this switch is actuated to a first position, a form 25 is advanced, burst, folded and rejected.

The REPRINT switch is functional only when the inserter is off line. If the switch is in the REPRINT position the inserter will reprint the previous form 25 and discharge the reprinted form 25 in the form reject area 40.

The ON/OFF LINE switch is used to select the ON LINE or OFF LINE status of the inserter. After the system has generated an error message, actuation of this switch clears the error.

In an optimum embodiment, an additional RERUN switch 165 is connected to CPU circuitry 162 and the embosser/encoder 22. Actuation of the RERUN switch provides for semiautomatic error recovery as described in the operation section below.

The electronic control circuitry 30 includes the central processing unit circuitry 162, input/output (I/O) interface circuitry 164, sensor interface circuitry 166, stepper motor driver circuitry 168 and solenoid driver circuitry 170.

The CPU circuitry 162 includes a central processing unit (CPU), programmable peripheral interfaces, an erasable programmable read-only memory (EPROM) and a random access memory (RAM). The EPROM contains the instructions of the system program which the CPU follows to initiate and control all operations. The RAM provides the CPU with the capacity to store and retrieve data and instructions. In a preferred embodiment, the CPU is an 8-bit microprocessor and the EPROM comprises four 2K×8 EPROM chips.

The input/output interface circuitry 164 functions as an interface between the CPU and the embosser/encoder 22 and solenoid driver circuitry 170. It should be noted that embosser/encoder 22 has its own CPU for controlling the embossing operation. The input/output (I/O) interface circuitry 164 also contains a programmable timer/counter used to generate card check and stepper motor interrupts.

The sensor interface circuitry 166 interfaces the CPU with various photocells and switches in the system. The "Paper" input to sensor interface circuitry 166 is connected to photocell 27 (FIG. 2). The "Hopper Full"0 input to interface circuitry 166 may be connected to a microswitch (not shown) for detecting when the output stacker 38 is full. The "TOF"0 input to sensor interface circuitry 166 is connected to the top-of-form photocell 29 (FIG. 2). The "Card In" input to sensor interface circuitry 166 is connected to track photocell 43 (FIG. 3). The "Card In Bin 1" input to sensor interface circuitry 166 is connected to the bin 1 photocell 55 (FIG. 4). The "Card In Bin 2" input to sensor interface circuitry 166 is connected to the bin 2 photocell 57 (FIG. 4). The "Right Card In Form" input to sensor interface 166 is connected to one of the pair of photocells 37 (FIG. 5). The "Left Card In Form" input to sensor interface 166 is connected to the other of the pair of photocells 37 (not shown in the drawings). The "Folder Out" input to sensor interface circuitry 166 is connected to photocell 39 (FIG. 2). The remaining two inputs to sensor interface circuitry 166 ("Envelope Switch" and "Stuffer Out") are activated in an optional embodiment of the inserter of the present invention in which an envelope stuffer 173 is connected to the output of the inserter. The "Envelope Switch" input is a signal indicating whether or not the envelope stuffer 173 is attached to the system and the "Stuffer Out" input is a signal indicating the output of an envelope from the Stuffer 173.

The stepper motor drive circuitry 168 is connected to the CPU and the stepper motor 172 for energizing the windings of the stepper motor 172 either individually or in pairs to advance the rotor of the stepper motor 172 through its 8-step cycle.

The solenoid driver circuitry 170 includes transistor drivers 174 and 176 for driving the solenoids and the print wires of printer 178, respectively. The transistor drivers 174 are used to drive the various solenoids in the inserter system and have the following outputs: Card Transfer, Insert, Clamp, Knife, Reject and Forms Counter.

The "Card Transfer" output is connected to rotary solenoid 49 (FIG. 3). The "Insert" output is connected to rotary solenoid 58 (FIG. 5). The "Clamp" output is connected to rotary solenoid 140 (FIG. 12). The "Knife" output is connected to rotary solenoid 152 (FIG. 12). The "Reject" output is connected to a rotary solenoid (not shown) for controlling the actuation of the form reject mechanism. The "Forms Counter" output is an optional output which may be connected to a solenoid (not shown) used in counting the number of forms.

The printer 178, which is a part of printer and paper drive apparatus 28, is a standard matrix wirehead printer. The printhead is driven by an AC synchronous motor which also drives ratchet mechanisms for advancing the print ribbon. The CPU controls the print motor and provides wire control words to the printhead through transistor drivers 176 in order to actuate the desired combination of wires. A printer control signal from the CPU includes a ribbon advance signal, printhead forward signal and printhead reverse signal, provided through switches 180, 182 and 184, respectively, for driving the printhead to print several lines of indicia.

FIGS. 17A–17D comprise a flow chart illustrating the software for the system of the present invention.

Figure 17A:
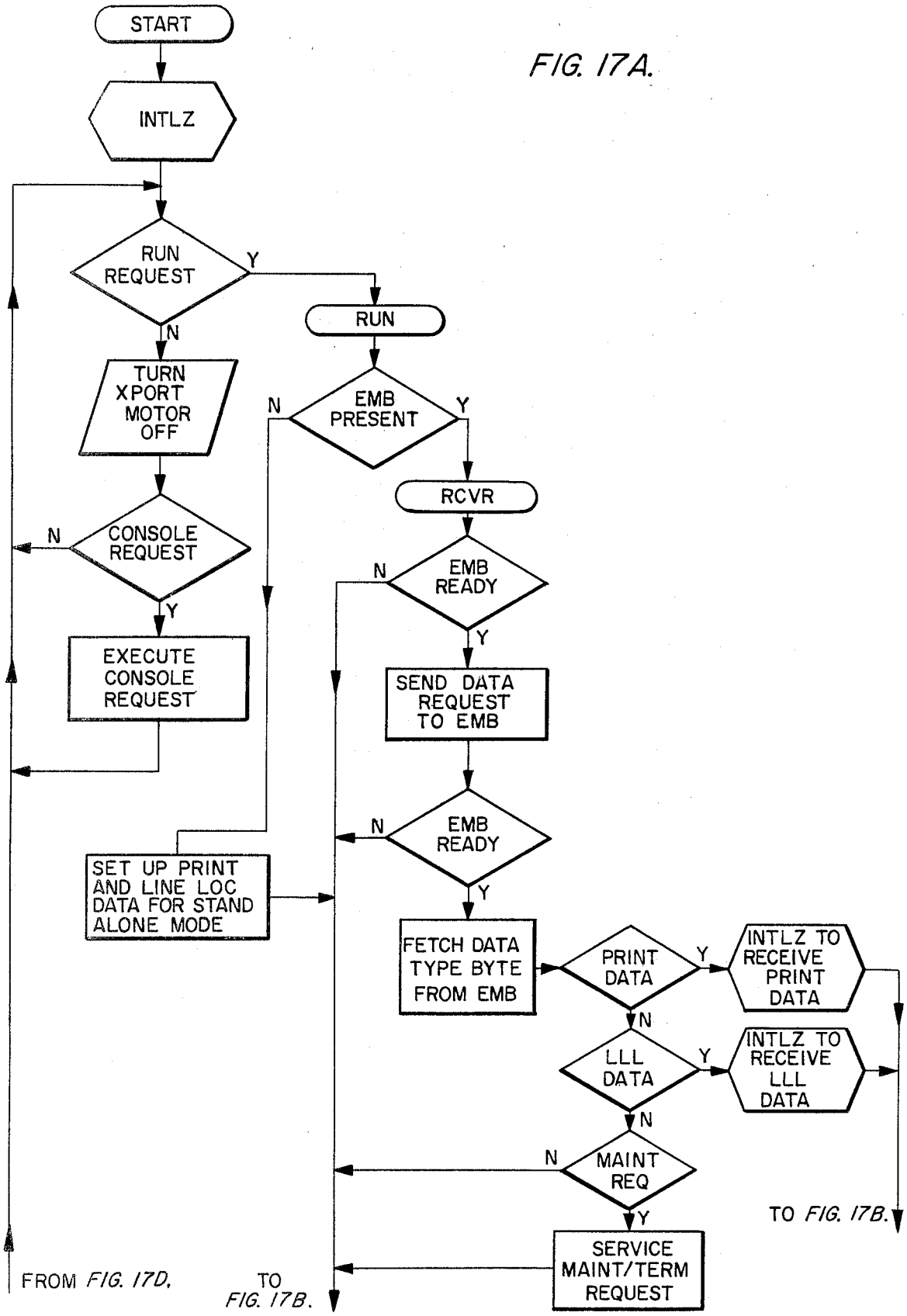
FIGS. 17A–17D comprise a flow chart illustrating the operation of the system of the present invention.

Referring to FIG. 17A, after the system is turned on and initialized, the CPU determines whether or not a run request exists (RUN REQUEST). If no run request is present then the transport motor 50 is turned off (TURN XPORT MOTOR OFF) and the CPU determines whether a console request is present (CONSOLE REQUEST). If a run request is present then the run mode is begun (RUN).

In the run mode, the CPU first determines whether the embosser/encoder 22 is set up for embossing operations (EMB PRESENT). If the embosser/encoder 22 is not to be used for embossing, then the stand alone mode is entered (SET UP PRINT AND LINE LOC DATA FOR STAND ALONE MODE). If, as is the usual case, the embosser/encoder 22 is to be used for embossing, then the CPU determines whether the embosser/encoder 22 is ready (EMB READY). If the embosser/encoder 22 is ready then a data request is sent to the embosser/encoder 22 (SEND DATA REQUEST TO EMB). Next, the CPU again determines whether the embosser/encoder 22 is ready (EMB READY) and, if it is, then a data type byte is fetched from the embosser/encoder 22 (FETCH DATA TYPE BYTE FROM EMB). After the data type byte has been fetched, the CPU determines whether the data is print type data (PRINT DATA). If it is print type data, then the system goes into a read mode of operation (READ). If it is not print type data, then the CPU determines whether it is line location data (LLL DATA) or a maintenance request (MAINT REQ) and processes the data accordingly.

Figure 17B:
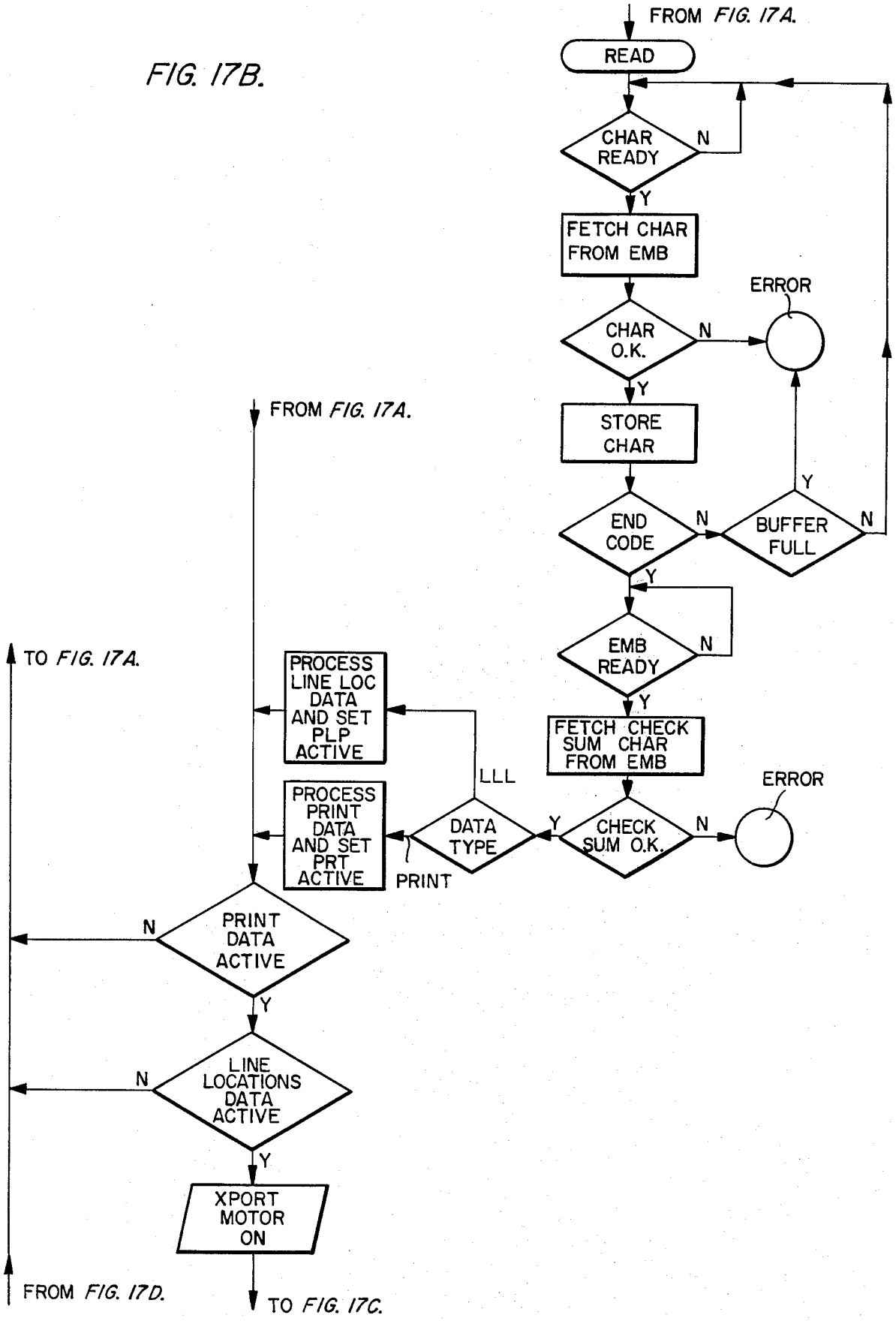

Referring to FIG. 17B, in the read mode of operation, the CPU determines whether the data is ready to be read (CHAR READY) and, if it is, then data is fetched from the embosser/encoder 22 for reading (FETCH CHAR FROM EMB). If the characters are properly read they are stored in memory (CHAR OK and STORE CHAR). If there is an error (ERROR), the data is reread. At the end of a block of data, an end code is received (END CODE) and the CPU then determines whether the embosser/encoder 22 is ready to proceed (EMB READY). After the data has been checked (FETCH CHECK SUM CHAR FROM EMB and CHECK SUM OK), the CPU determines whether it is print data or line location data (DATA TYPE), and the data is processed accordingly (PROCESS LINE LOC DATA AND SET PLP ACTIVE and PROCESS PRINT DATA AND SET PRT ACT).

After the print data and line location data have been processed, the transport motor 50 is turned on (XPORT MOTOR ON) and the system is placed in the transport and print cycle mode of operation (XPC).

Figure 17C:
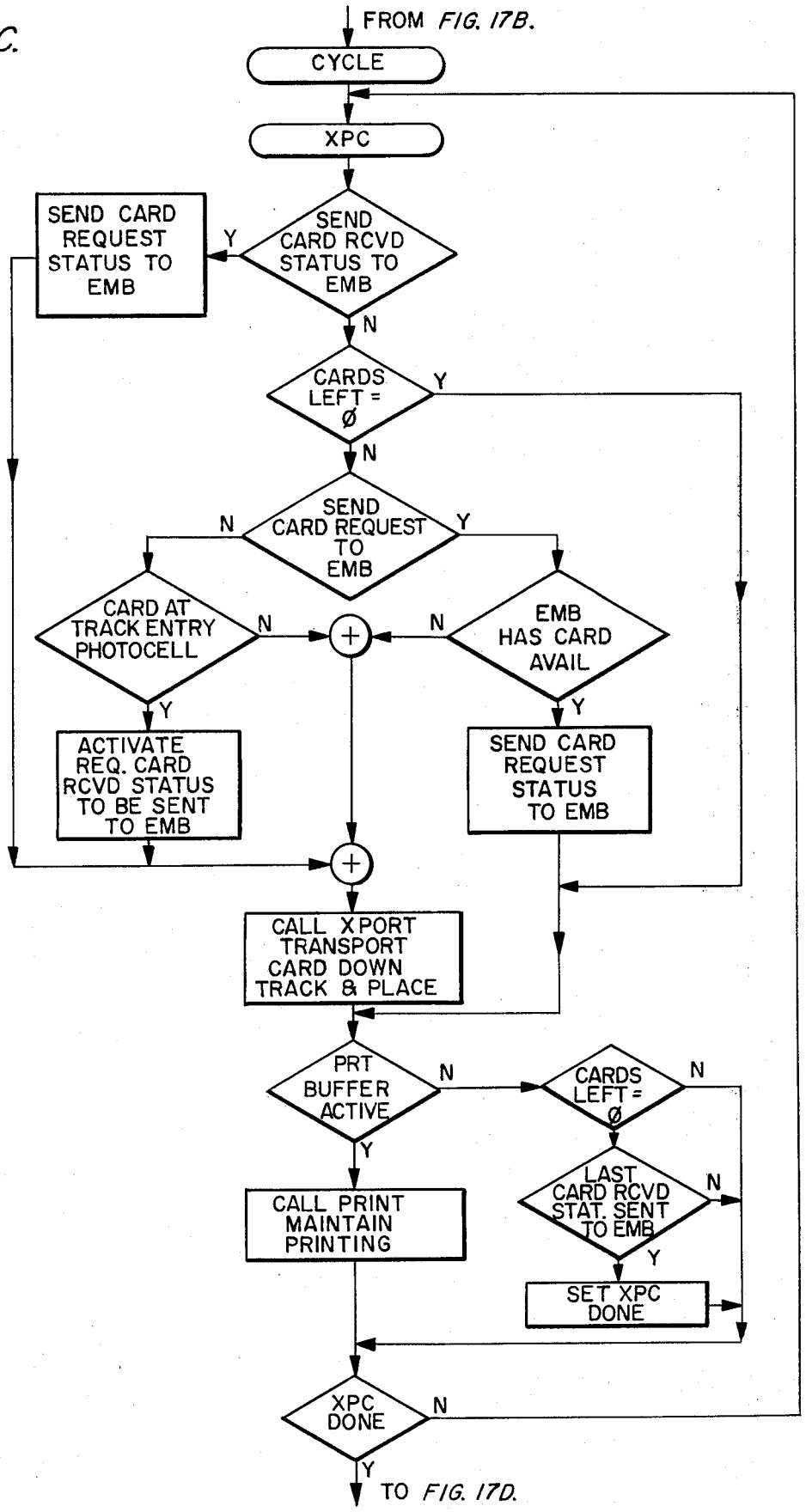

Referring to FIG. 17C, in the transport and print mode, the CPU first determines if it has sent a card received status signal to the embosser/encoder 22 (SEND CARD RCVD STATUS TO EMB). If the signal has been sent, then the CPU sends a send card request status signal to the embosser/encoder 22 (SEND CARD REQUEST STATUS TO EMB) and a card is transported down the track (CALL XPORT TRANSPORT CARD DOWN TRACK & PLACE). If no card 72 is received, the CPU then determines whether there are any cards 72 left in the embosser/encoder 22 (CARDS LEFT=0). If no cards 72 are left in the embosser/encoder 22, then the system ceases to inquire as to card status. If there are cards 72 left in the embosser/encoder 22, the CPU determines whether a card request has been sent to the embosser/encoder 22 (SEND CARD REQUEST TO EMB). If a card request has been sent, the CPU determines whether the embosser/encoder 22 has an available card 72 (EMB HAS CARD AVAIL). If a card 72 is available, then the card request status signal is sent to the embosser/encoder 22 (SEND CARD REQUEST STAT TO EMB). If no card 72 is available, then a request to transfer cards down the track is made (CALL XPORT TRANSPORT CARD DOWN TRACK & PLACE). If no card request has been sent to the embosser/encoder 22, then the CPU determines whether there is a card 72 at the track entry photocell 43 (CARD AT TRACK ENTRY PHOTOCELL). If there is no card 72 at the track, then the transport mechanism is called. If there is a card 72 at the track entry photocell 43, then a requested card received status signal is sent to the embosser/encoder 22 (ACTIVATE REQ CARD RCVD STAT TO BE SENT TO EMB) and the transport mechanism is again called.

Once the transport has been called, or if the transport has not been called (for example, if there are no cards left), the CPU then determines whether the print buffer is active (PRT BUFFER ACTIVE). If the print buffer is active, then printing is begun (CALL PRINT MAINTAIN PRINTING). If the print buffer is not active, then the CPU determines whether there are any cards 72 left (CARDS LEFT=0). If there are no cards 72 left, then the CPU determines whether the last card received status signal has been sent to the embosser/encoder 22 (LAST CARD RCVD STAT SENT TO EMB). If this signal has been sent, then the transport and print cycle is completed (SET XPC DONE). If there are cards left or if the last card received status signal has not been sent to the embosser/encoder 22, then the CPU determines whether the transport and print cycle has been completed (XPC DONE). If the printing cycle has not been completed, then the system is recycled back to the beginning of the transport and print cycle mode.

Figure 17D:
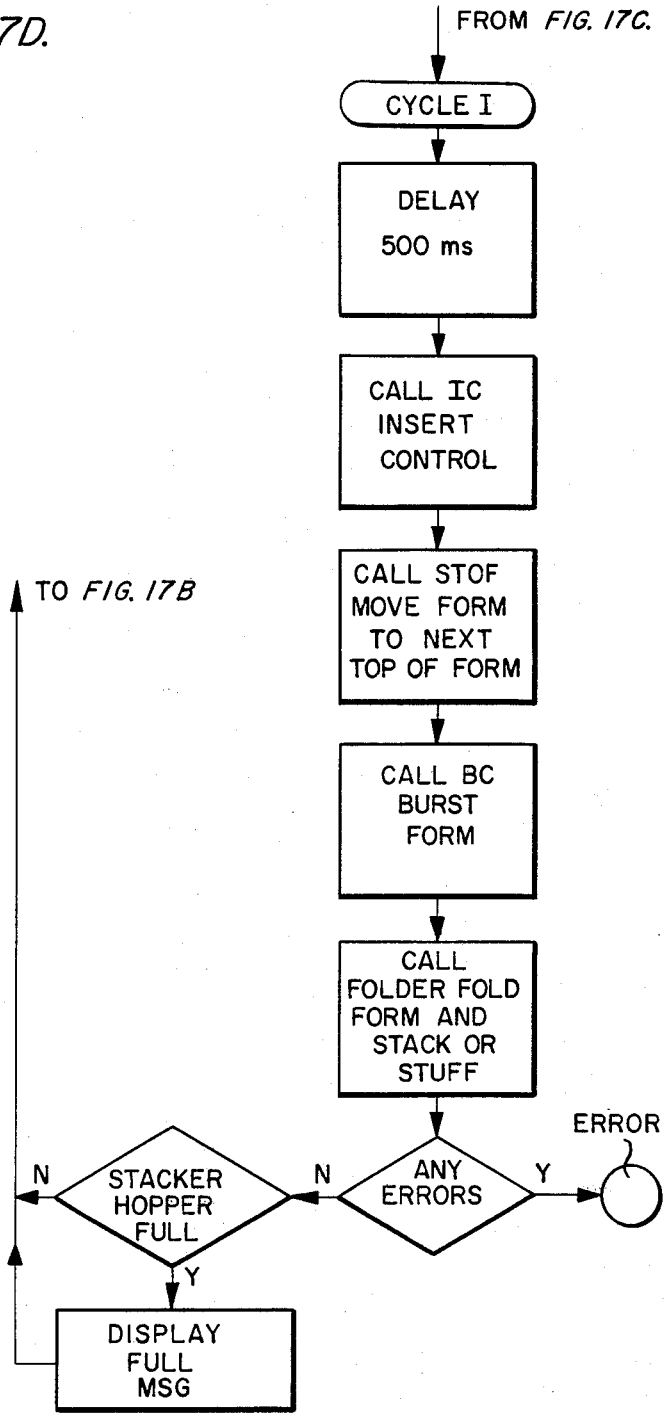

Referring to FIG. 17D, if the printing cycle has been completed, then the insert cycle mode of operation is begun (CYCLE I). A delay operation totalling a delay of 500 milliseconds is conducted to steady the form (DELAY 500 ms). Next, the insert control operation is called (CALL IC INSERT CONTROL) and the mailer form 25 is transported to pick up the cards 72. Transport of the forms 25 is halted when the succeeding form 25 is at the top of form position (CALL STOF MOVE FORM TO NEXT FORM), and the bursting operation is called (CALL BC BURST FORM) to burst the completed mailer form 25. Next the folder operation is called (CALL FOLDER FOLD FORM AND STACK OR STUFF) and the completed form is folded and stacked or optionally stuffed into an envelope. The system is then checked for errors. If there are no errors, then the CPU determines whether the stacker hopper 38 is full (STACKER HOPPER FULL) and, if the stacker hopper 38 is not full, the system goes into the run mode of operation again (RUN). If the stacker hopper 38 is full, then a full message is displayed on display panel 156 (DISPLAY FULL MSG).

The operation of the system is as follows. Once the form printing and card attachment apparatus 20 and the embosser/encoder 22 have been turned on, the CPU circuitry 162 activates the AC transport drive motor (track motor 50) when it has active print data and print line position codes from the embosser/encoder 22. After a card is topped (the raised characters are coated) the solenoid driven arm 33 pushes the data card 72 onto the transport belts 42. Three photocells (photocells 43, 55 and 57) monitor the successive positions of the card 72 while it is transported. When the card 72 passes photocell 43 (FIG. 3) the CPU activates a software timer and sends an acknowledgment signal to the embosser/encoder 22 to indicate that the card 72 has been received. It should be recalled recalled that embosser-/encoder 22 has its own CPU (and associated memory, etc.) for communicating with the CPU circuitry 162 of the inserter system 20. If the embosser/encoder CPU does not receive this acknowledgment signal within a preset time interval, it halts system operation and displays an error message on the embosser console (not shown). The software timer activated by the CPU circuitry 162 is used to insure that the card travels the distance between photocell 43 and the photocell 55 (mounted over the first bin 45) in a predetermined length of time. When the card 72 reaches photocell 55, the timer is disabled (FIG. 4).

A setting designating the ratio of cards per mailer form (NUMBER OF CARDS/FORM data, FIG. 18) determines whether the first card 72 drops in bin 45 or continues on to bin 47. If the ratio equals 1, the card 72 falls into bin 45 and transport is complete. If the ratio equals 2, rotary solenoid 49 is energized and pinch roller 53 grips the card against the transport belts 42, thereby preventing it from falling into bin 45. The card 72 accordingly is transported to bin 47. A software timer is again employed to insure that the card 72 travels the distance from photocell 55 to photocell 57 within a predetermined time interval. When the second card reaches bin 45, the rotary solenoid 49 is not energized, so that the second card 72 drops into bin 45 (FIG. 4).

When the form printing and card attachment apparatus 20 is ready to process a form and cards, it sends a request for a card and PRINT DATA to the embosser-/encoder 22. If a particular mailer form 25 requires two cards 72, the CPU circuitry 162, upon receipt of the first card 72, sends a request for a second card to the embosser/encoder 22. If the second card 72 is available, the embosser/encoder 22 sends the second card 72 (which has already been embossed by this time) to the form printing and card attachment apparatus 20. However, if the embosser/encoder 22 is holding a card 72 and PRINT DATA (i.e., it is data for the succeeding mailer form 25), the CPU for the embosser/encoder 22 detects an error (i.e., the proper second card 72 for the present form is missing); the system thereupon is shut down and an error message is displayed on the embosser console (not shown). It is then necessary for the operator to clear the inserter by actuating the CLEAR switch. This causes the printed form 25 to pick up the first card 72, and the form 25 (carrying only the first of two required cards) is folded and rejected into the form reject area 40. Prior to the generation of the error message, the card for the next form has already been embossed and remains in embosser/encoder 22. The operator may actuate the ON LINE switch to restart the system.

In an optimum embodiment, upon noting an error message, the operator may actuate the RERUN switch 165 to reject all forms remaining in the form printing and card attachment apparatus 20 and all cards remaining in the embosser/encoder 22. The actuation of the RERUN switch 165 also sends a signal to the embosser-/encoder 22 to cause the embosser/encoder 22 to reverse the magnetic tape (FIG. 18) to the data portion where the error signal was generated and restart the system. In this manner, once an entire magnetic tape has been processed by the system of the present invention, there are no individually defective forms or cards which need to be corrected.

The form printing and card attachment CPU also monitors the photocells 55 and 57 to insure that the cards 72 drop into the bins properly. If a card jams or hangs up at any point during transport or in dropping into one of bins 45 and 47, the entire system is halted and a card error message appears on the display 156. Similarly, if a form 25 jams, an error signal is generated. The operator will then manually clear the jammed form and may reprint the jammed form by actuating the REPRINT switch which causes a reprinted form to be burst and fed to the form reject area 40. The operator then takes the cards out of the jammed form and places them in the reprinted form. The system is then restarted by actuating the ON LINE switch.

The printer 178 receives identification information from the storage device (e.g., magnetic tape) in the embosser/encoder 22 by way of CPU circuitry 162 and prints indicia on the mailer form 25 as the card 72 (the first card, if two cards are required) is being transported to the card attachment mechanism. As mentioned above, the printer 178 comprises a standard matrix printer, for example, a 5×7 dot matrix printer. The paper photocell 27 detects whether or not there is another mailer from 25 in the form printing and card attachment apparatus 20. The "top of form" photocell 29 checks for a "top of form" hole in the mailer form 25 because the mailer form 25 must be at the "top of form" position when printing begins.

After printing is completed and the card(s) is loaded into the bin(s) 45 (and 47), the CPU causes the stepper motor 172 to advance the mailer from to a pre-insert position. In this position the lower edge of the mailer form 25 is approximately ½ inch below the printhead, and the divergent slots 92 in the mailer form 25 are just below the level of the card(s) 72. The CPU 162 then energizes rotary solenoid 58, thereby causing upright plate 68 to be moved against mailer form 25 so that the spring biased fingers 80 open the slots 92 in the mailer form 25. After a 200 millisecond delay the CPU activates the stepper motor 172 to advance the succeeding (blank) mailer form to the top of form position, as monitored by photocell 29. As the printed mailer form 25 advances, the card(s) 72 is (are) received in the opposite ends thereof in the corresponding slots 92 of the mailer form 25.

When the succeeding mailer form 25 reaches the "top of form" position, following the pickup of the card(s) 72, the card-carrying printed mailer form is ready to be separated from the remaining serially connected mailer forms 25. First, the CPU sets a 50 millisecond delay to allow the mailer forms 25 to stabilize. Next, rotary solenoid 140 (FIG. 12) is energized to secure the burst line between the card-carrying, printed mailer form and the succeeding blank mailer form 25 against U-shaped channel member 128. After a 100 millisecond delay, the CPU energizes rotary solenoid 152, thereby driving burster knife 146 forward to separate the mailer forms 25 along the burst line. Then the CPU de-energizes rotary solenoids 140 and 152 and sets a 50 millisecond delay to allow burster knife 146 and roller 144 to retract.

After the card-carrying printed mailer form 25 has been burst, it is then transported through folder station 36 where it is folded along pre-formed fold lines.

From folder station 36, the card-carrying printed mailer form 25 is fed to output stacker 38. Alternatively, the mailer form 25 may be fed to an envelope stuffer 173.

After turning on folder motor 122, the CPU checks to see if the cards 72 are properly inserted in the mailer form 25. A card 72 is properly inserted if the hole 93 at the bottom of the card receiving area of the mailer form 25 is approximately $\frac{2}{3}$ covered. Using timers, the CPU checks to see if the photocells 37 sense light for the proper length of time as the mailer form 25 travels past them. If a card 72 is not inserted far enough, or if it totally covers hole 93, the CPU circuitry 162 detects the error and energizes a reject solenoid (not shown) so that the mailer form 25 is outputted in the form reject area 40. An error message then appears on inserter display 156 and system operation is halted. The CPU circuitry 162 also checks to see if mailer form 25 remains in the folder station 36 less than two seconds by monitoring photocells 37 and 39. When an acceptable mailer form 25 clears photocell 39, a forms counter (not shown) is incremented. The stacker station 38 has an AC drive motor 186 which is activated simultaneously with the activation of folder motor 122. If the CPU circuitry 162 detects any errors in the mailer form at any time in the insertion cycle, then the reject solenoid is activated and the form is rejected into the form reject area 40.

The system of the present invention may be implemented in numerous ways. The data cards may be coded in any suitable manner, for example, by embossing, printing or encoding a magnetic stripe carried by the data cards. Similarly, the carrier forms may be marked in any suitable manner, for example, by printing or coding the carrier forms. In addition, although for convenience the system has been shown to accommodate either 1 or 2 cards, it readily can accommodate 3 or 4 cards per form. In the latter instance, the CPU circuitry 162, upon receipt of the second card, sends a request for the card to the embosser/encoder 22. Thus, the 3rd and 4th cards are processed in the same manner as the first and second cards.

The many features and advantages of the invention are apparent from the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A system for automatically attaching data cards authorized to be issued for predetermined accounts and coded with predetermined card account information, to respectively associated carrier forms having printed thereon corresponding, predetermined form account information, said system including means for operative connection to a common data base containing the account information for both the cards and the forms for a plurality of accounts, and comprising:

means for deriving the associated, predetermined card account information and predetermined form account information from the common data base in predetermined timed relationship for each account, and in individual succession for plural said accounts;

means for attaching data cards having card account information coded thereon to carrier forms having corresponding form account information printed thereon;

means for coding blank data cards in accordance with predetermined card account information supplied thereto;

means for printing predetermined account information on blank carrier forms, in individual succession corresponding to a succession of plural accounts for which data cards are authorized to be issued;

means for supplying coded data cards to said attaching means, in individual succession as to the data cards authorized to be issued for each of a succession of plural accounts;

said deriving means including means for supplying the predetermined card account information to said coding means in accordance with the number of data cards authorized to be issued for a given account, and for supplying, in timed relationship, synchronized with the supply of the predetermined card account information to said coding means, the predetermined form account information for the given account to said printing means; and said printing means including means for supplying successive printed carrier forms to said attaching means in timed relationship synchronized with the successive supply of coded data cards for the respectively corresponding accounts, to said attaching means by said means for supplying coded data cards;

said attaching means including means for attaching the correct number of coded data cards to the respectively corresponding printed carrier form, in individual succession for the successive plural accounts.

2. The system as set forth in claim 1, wherein said common data base includes control data for indicating the authorized number of data cards for a given account and wherein said deriving means includes means for selectively deriving control data from the common data base in succession for plural accounts, said system further comprising means for supplying control data for a given account to said printing means, wherein said printing means includes means for sending a second card request signal to said coding means, in dependence upon said control data, after a first of the coded data cards for the given account is supplied to said attaching means, said coding means including means for generating an error signal if a second of the coded data cards for the given account is not available when the second card request signal is received by said coding means.

3. The system as set forth in claim 2, wherein:

said attaching means includes a card attachment station and means for transporting the coded data cards from said means for supplying coded data cards to said card attachment station, said transporting means comprises first sensor means for providing a first sensor signal to said printing means when one of the coded data cards passes said transporting means, said card attachment station comprises second sensor means for generating a second sensor signal when one of the coded data cards is received at said card attachment station, and said printing means includes means for establishing a predetermined period of time for receiving said first and second sensor signals and for generating an error signal if the length of time between receipt of said first and second sensor signals exceeds the predetermined period of time.

4. The system as set forth in claim 3, wherein the carrier forms each have first and second divergent slots provided therein for holding a data card and wherein said card attachment station comprises:

means for receiving and releasably holding each of the coded data cards for the given account;

a guide member, having first and second guide slots, positioned parallel to the carrier forms;

a pivot rod connected to said guide member; and first and second spring biased fingers pivotally connected to said pivot rod and positioned to protrude through said first and second guide slots, respectively, wherein said first and second spring biased fingers deflect a portion of the form adjacent to the first and second divergent slots, respectively, out of the form so that the printed carrier form picks up the corresponding coded data cards for the given account.

5. The system as set forth in claim 1, wherein the carrier forms are serially connected, said system further comprising burster means for separating a printed one of the serially connected carrier forms from the remaining blank serially connected carrier forms.

6. The system as set forth in claim 5, wherein the serially connected carrier forms are separated by a burst line and wherein said burster means comprises:

a U-shaped channel member having an open end positioned on one side of the serially connected carrier forms;

clamp means, positioned on the opposite side of the serially connected carrier forms, for selectively clamping the burst line, which separates the printed one of the serially connected carrier forms from the remaining blank serially connected carrier forms, against the open end of said U-shaped channel member; and knife means movably positioned inside said clamp means, for cutting the printed one of the serially connected carrier forms from the remaining blank serially connected carrier forms at the burst line.

7. The system as set forth in claim 6, wherein said printing means generates a burst signal and wherein said knife means comprises:

a knife blade positioned inside said clamp means;

a first linkage member pivotally connected to said knife blade;

a second linkage member pivotally connected to said knife blade, said second linkage member longer than said first linkage member;

a triangular linkage member, having a first corner pivotally connected to said first linkage member, having a second corner pivotally connected to said second linkage member and having a third corner; and a rotary solenoid connected to the third corner of said triangular linkage member and operatively connected to said electronic control means, wherein said rotary solenoid is actuated, upon receipt of the burst signal, to cause said triangular linkage member to move said first and second linkage members which in turn move said knife blade to engage and cut the burst line.

8. The system as set forth in claim 5, 6 or 7, further comprising means for folding the separated carrier forms.

9. The system as set forth in claim 8, further comprising means for stacking the folded carrier forms.

10. The system as set forth in claim 9, further comprising means for stuffing the folded carrier forms in envelopes.

11. A system for attaching data cards authorized to be issued for predetermined accounts and coded with predetermined card account information, to respectively associated carrier forms having corresponding predetermined form account information printed thereon, said system including means for operative connection to a common data base containing the account information for both the cards and the forms for a plurality of accounts, and comprising:

coding means for supplying predetermined card account information and predetermined form account information, said coding means including means for deriving the predetermined card account information and the predetermined form account information from the common data base and means for coding the predetermined card account information, for a given account, on first and second blank data cards;

means for supplying blank carrier forms in individual succession;

printing means, operatively connected to said coding means, for receiving the predetermined form account information for the given account and for printing the predetermined form account information for the given account on one of the blank carrier forms in timed relationship synchronized with the coding of the predetermined card account information for the given account on the first and second blank data cards;

a card attachment station;

means for transporting the coded first and second data cards from said coding means to said card attachment station; and means for transporting the printed one of the carrier forms to said card attachment station in timed relationship synchronized with the transport of the coded first and second data cards to said card attachment station;

said card attachment station including means for receiving and releasably holding the first and second coded data cards in a desired pickup position, and means for attaching the first and second coded data cards for the given account to the corresponding printed one of the carrier forms.

12. The system as set forth in claim 11, wherein said printing means comprises electronic control means for generating a control signal and wherein said card attachment station further comprises means, operatively connected to said electronic control means, for moving said receiving and holding means to engage the printed one of the carrier forms in response to said control signal.

13. The system as set forth in claim 12, wherein said moving means comprises:

a linkage connected to said receiving and holding means; and a rotary solenoid, connected to said linkage and operatively connected to said electronic control means, for moving said linkage in response to said control signal.

14. The system as set forth in claim 11 or 12, wherein the carrier forms each have first, second, third and fourth divergent slots provided therein for holding the first and second coded data cards for the given account and wherein said attaching means comprises:

a guide member, having first, second, third and fourth guide slots, positioned parallel to the carrier forms;

a pivot rod connected to said guide member; and first, second, third and fourth spring biased fingers pivotally connected to said pivot rod and positioned to protrude through said first, second, third and fourth guide slots, respectively, wherein said first, second, third and fourth spring biased fingers deflect a portion of the form adjacent to the first, second, third and fourth divergent slots, respectively, out of the form so that the printed one of the carrier forms picks up the corresponding first and second coded data cards for the given account as the printed one of the carrier forms is transported past said card attachment station.

15. The system as set forth in claim 12, further comprising:

first sensor means, positioned adjacent said means for transporting the first and second coded data cards, for providing a first sensor signal to said electronic control means when one of the first and second coded data cards enters the transporting means; and second sensor means, positioned adjacent said means for receiving and releasably holding the first and second coded data cards, for providing a second sensor signal to said electronic control means when one of the first and second coded data cards is received at said receiving and holding means, wherein said electronic control means includes means for establishing a predetermined period of time for receiving said first and second sensor signals and means for generating an error signal if the length of time between receiving said first and second sensor signals exceeds the predetermined period of time.

16. The system as set forth in claim 15, wherein said first and second sensor means comprise photocells.

17. The system as set forth in claim 11, wherein said electronic control means generates a transport signal and wherein said means for transporting the first and second coded data cards comprises:

a transport motor, operatively connected to said electronic control means, driven in response to the transport signal;

a drive pulley driven by said transport motor;

a plurality of transport belts driven by said drive pulley, said plurality of transport belts for transporting the first and second coded data cards to said card attachment station; and a plurality of idler rollers for supporting said plurality of transport belts.

18. The system as set forth in claim 11, wherein the carrier forms are serially connected, said system further comprising burster means for separating the printed one of the serially connected carrier forms from the remaining blank serially connected carrier forms.

19. The system as set forth in claim 18, wherein the serially connected carrier forms are separated by a burst line and wherein said burster means comprises:

a U-shaped channel member having an open end positioned on one side of the serially connected carrier forms;

clamp means, positioned on the opposite side of the serially connected carrier forms, for selectively clamping the burst line, which separates the printed one of the serially connected carrier forms from the remaining blank serially connected carrier forms, against the open end of said U-shaped channel member; and knife means movably positioned inside said clamp means, for cutting the printed one of the serially connected carrier forms from the remaining blank serially connected carrier forms at the burst line.

20. The system as set forth in claim 19, wherein said electronic control means generates a burst signal and wherein said knife means comprises:

a knife blade positioned inside said clamp means;

a first linkage member pivotally connected to said knife blade;

a second linkage member pivotally connected to said knife blade, said second linkage member longer than said first linkage member;

a triangular linkage member, having a first corner pivotally connected to said first linkage member, having a second corner pivotally connected to said second linkage member and having a third corner; and a rotary solenoid connected to the third corner of said triangular linkage member and operatively connected to said electronic control means, wherein said rotary solenoid is actuated, upon receipt of the burst signal, to cause said triangular linkage member to move said first and second linkage members which in turn move said knife blade to engage and cut the burst line.

21. The system as set forth in claim 18, further comprising means for folding the separated carrier forms.

22. The system as set forth in claim 21, further comprising means for stacking the folded carrier forms.

23. The system as set forth in claim 22, further comprising means for stuffing the folded carrier forms in envelopes.

24. A system for attaching data cards authorized to be issued for predetermined accounts and coded with predetermined card account information, to respectively associated carrier forms having predetermined form account information printed thereon, comprising:

means for supplying identifying information in synchronized timed relationship for each of a plurality of accounts, said identifying information including predetermined card account information and a print signal including number of cards per form data and predetermined form account information, said number of cards per form data indicating the required number of data cards to be attached to a respectively associated carrier form for a given account;

coding means for receiving the predetermined card account information from said means for supplying identifying information and for coding the predetermined card account information on the data cards;

a card attachment station;

means for transporting, in succession, the coded data cards to said card attachment station;

electronic control means, operatively connected to said means for supplying identifying information, for receiving the print signal, for providing, as an output, the predetermined form account information, and for sending a second card request signal to said coding means, in dependence upon the number of cards per form data, after a first of the coded data cards for a given account is received at said transporting means;

means for supplying blank carrier forms in individual succession;

means, operatively connected to said electronic control means, for receiving the predetermined form account information from said electronic control means and for printing, on one of the blank carrier forms, the predetermined form account information corresponding to the predetermined card account information coded on the data cards for the given account, said printing occurring in timed relationship synchronized with the coding of the predetermined card account information on the data cards by said coding means; and means for transporting the printed one of the carrier forms past said card attachment station after the transport of the coded data cards for the given account to said card attachment station;

said card attachment station comprising means for receiving and releasably holding the coded data cards for the given account and means for attaching the coded data cards to the respectively associated printed carrier form for the given account;

said coding means including means for generating an error signal if the print signal is being generated when the second card request signal is received by said coding means.

25. The system as set forth in claim 24, wherein the carrier forms each have first and second divergent slots provided therein for holding a data card and wherein said attaching means comprises:

a guide member having first and second guide slots, positioned parallel to the carrier form;

a pivot rod connected to said guide member; and first and second spring biased fingers pivotally connected to said pivot rod and positioned to protrude through said first and second guide slots, respectively, wherein said first and second spring biased fingers deflect a portion of the form adjacent to the first and second divergent slots, respectively, out of the form, so that the printed carrier form picks up the corresponding coded data cards for the given account as the printed carrier form is transported past said card attachment station.

26. The system as set forth in claim 24, wherein:

said means for transporting the coded data cards includes first sensor means for providing a first sensor signal to said electronic control means when one of the data cards passes through said transporting means, said card attachment station further comprises second sensor means for generating a second sensor signal when one of the data cards is received at said receiving and holding means, and said electronic control means includes means for establishing a predetermined period of time for receiving said first and second sensor signals and means for generating an error signal if the length of time exceeds the predetermined period of time.

* * * * *

UNITED STATES PATENT AND TRADEMARK OFFICE

CERTIFICATE OF CORRECTION

PATENT NO. : 4,384,196

DATED : MAY 17, 1983

INVENTOR(S) : ROGER D. MCCUMBER ET AL.

It is certified that error appears in the above-identified patent and that said Letters Patent is hereby corrected as shown below:

Col. 4, line 33, change "FIg" to --FIG--.
Col. 6, line 34, change "from" to --form--.
Col. 8, line 68, change "from" to --form--.
Col. 9, line 68, delete "0".
Col. 10, line 3, delete "0".
Col. 13, line 3, delete "recalled" (second occurrence).
Col. 14, line 32, change "from" to --form--.

Signed and Sealed this

*Twenty-third* Day of *August 1983*

[SEAL]

*Attest:*

GERALD J. MOSSINGHOFF

*Attesting Officer*

*Commissioner of Patents and Trademarks*